US007581821B2

(12) United States Patent
Hatsui et al.

(10) Patent No.: US 7,581,821 B2
(45) Date of Patent: Sep. 1, 2009

(54) HEAD SUBSTRATE, PRINTHEAD, HEAD CARTRIDGE, AND PRINTING APPARATUS

(75) Inventors: Takuya Hatsui, Tokyo (JP); Yoshiyuki Imanaka, Kawasaki (JP); Yoshiyuki Toge, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 119 days.

(21) Appl. No.: 11/836,425

(22) Filed: Aug. 9, 2007

(65) Prior Publication Data

US 2007/0285459 A1 Dec. 13, 2007

Related U.S. Application Data

(60) Division of application No. 11/564,684, filed on Nov. 29, 2006, now Pat. No. 7,364,284, which is a continuation of application No. PCT/JP2005/009899, filed on May 30, 2005.

(30) Foreign Application Priority Data

Jun. 2, 2004 (JP) ..... 2004-164555
May 23, 2005 (JP) ..... 2005-149620

(51) Int. Cl.
*B41J 2/05* (2006.01)

(52) U.S. Cl. ..... 347/59; 347/65; 347/67

(58) Field of Classification Search ..... 347/59, 347/65, 67

See application file for complete search history.

(56) References Cited

U.S. PATENT DOCUMENTS 5,126,759 A 6/1992 Small et al.
5,166,702 A 11/1992 Mattern et al.
5,253,934 A 10/1993 Potucek et al.
5,264,868 A 11/1993 Hadley et al.
5,363,134 A 11/1994 Barbehenn et al.
5,471,163 A 11/1995 Childers
5,610,635 A 3/1997 Murray et al.
5,956,052 A 9/1999 Udagawa et al.
6,130,692 A 10/2000 Mochizuki et al.
6,390,589 B1 5/2002 Imanaka et al.

(Continued)

FOREIGN PATENT DOCUMENTS

EP 0 571 093 A2 11/1993

(Continued)

*Primary Examiner*—Thinh H Nguyen
(74) *Attorney, Agent, or Firm*—Fitzpatrick, Cella, Harper & Scinto

(57) ABSTRACT

An object of this invention is to provide a head substrate having a fuse ROM without increasing the size. To achieve the object, a head substrate includes an ink supply port which has a long hole shape elongated in a first direction, a plurality of printing elements arrayed along the first direction on both sides of the ink supply port, a plurality of first driving elements, arrayed along the first direction at positions spaced apart further away from the ink supply port than the plurality of printing elements, for driving the plurality of printing elements, a plurality of fuse ROMs which store information, and a plurality of second driving elements for driving the plurality of fuse ROMs. A signal line used for driving the plurality of first driving elements and second driving elements is shared. The plurality of second driving elements are arranged on the same array as the first driving elements at positions adjacent to both ends of each array of the plurality of first driving elements.

6 Claims, 20 Drawing Sheets

U.S. PATENT DOCUMENTS

| | | | |
|---|---|---|---|
| 6,820,958 | B2 | 11/2004 | Miyakoshi |
| 7,029,081 | B1 | 4/2006 | Imanaka et al. |
| 7,216,960 | B2 | 5/2007 | Imanaka et al. |
| 2002/0036781 | A1 | 3/2002 | Hirayama |
| 2002/0140751 | A1 | 10/2002 | Imanaka et al. |
| 2005/0285904 | A1 | 12/2005 | Toge et al. |
| 2006/0238558 | A1 | 10/2006 | Hatasa et al. |
| 2007/0002087 | A1 | 1/2007 | Matsui et al. |
| 2007/0008382 | A1 | 1/2007 | Hatsui et al. |
| 2007/0091131 | A1 | 4/2007 | Hatsui et al. |

FOREIGN PATENT DOCUMENTS

| | | |
|---|---|---|
| EP | 0 997 280 A2 | 5/2000 |
| JP | 62-288065 (A) | 12/1987 |
| JP | 3-126560 (A) | 5/1991 |
| JP | 5-501684 (A) | 4/1993 |
| JP | 6-957 (A) | 1/1994 |
| JP | 6-91877 (A) | 4/1994 |
| JP | 10-138482 (A) | 5/1998 |
| JP | 2000-198202 (A) | 7/2000 |
| JP | 2002-29055 | 1/2002 |
| JP | 3428683 (B2) | 5/2003 |
| JP | 2005-503949 | 2/2005 |
| WO | WO 03/029010 | 4/2003 |

HEAD SUBSTRATE, PRINTHEAD, HEAD CARTRIDGE, AND PRINTING APPARATUS

This is a divisional application of application Ser. No. 11/564,684, filed Nov. 29, 2006, now allowed, which is a continuation application of International application Ser. No. PCT/JP2005/009899, filed on May 30, 2005.

TECHNICAL FIELD

The present invention relates to a head substrate, printhead, head cartridge, and printing apparatus, and, more particularly, to, e.g., a head substrate having a fuse ROM for holding/reading information, a printhead or head cartridge using the head substrate, and a printing apparatus using the printhead or head cartridge.

BACKGROUND ART

There is a proposal to arrange a ROM (Read Only Memory) on a head substrate integrated on an inkjet printhead (to be referred to as a printhead hereinafter) included in a recent inkjet printing apparatus (to be referred to as a printing apparatus hereinafter) to freely read out or hold information (individual information) unique to the head, including the ID (Identify) code of the printhead itself and the driving characteristic of the ink discharge mechanism.

In an arrangement using a printhead detachable from a printing apparatus main body, this approach is especially effective in acquiring information unique to the printhead. Patent reference 1 discloses arranging an EEPROM (Electrically Erasable Programmable ROM) in a printhead.

In another known method, a resistance indicating information unique to a head is formed on the base substrate of a head substrate together with the layer films of, e.g., an ink discharge mechanism. This approach is effective when the amount of information to be held in the printhead is relatively small. This method also allows a printing apparatus to obtain information unique to the printhead by reading the value of the resistance formed on the base substrate. The printing apparatus is capable of optimum driving for ink discharge based on the information.

Patent reference 2 discloses forming, on a base substrate used for manufacturing a head substrate, a fuse serving as a ROM (to be referred to as a fuse ROM hereinafter) simultaneously together with the layer films of, e.g., an ink discharge mechanism. When the fuse ROM is selectively melted under the control of a simultaneously formed logic circuit, the fuse ROM can hold binary data based on the presence/absence of the fuse.

A printhead having the above-described head substrate can simplify the structure, improve the productivity, reduce the cost, and reduce the weight and size while holding the information unique to the head.

Patent reference 1: Japanese Patent Publication Laid-Open No. 3-126560

Patent reference 2: Japanese Patent Publication No. 3428683

DISCLOSURE OF INVENTION

Problems that the Invention is to Solve

However, the printhead capable of storing individual information as described above in the prior art has the following problems to solve.

If the amount of data to be stored is large, it is useful to use an arrangement including a ROM chip such as an EEPROM separately from a head substrate. However, this inevitably increases the cost. Especially, when the amount of data to be stored is not large, a product according to this arrangement is not competitive in price in view of recent cost reduction of printing apparatuses. The printhead is also disadvantageous with regard to increasing productivity and reducing size and weight.

If the amount of data to be stored is not large, it is also possible to arrange, as a fuse ROM which serves as means for storing information, a heat generating element serving as an electrothermal transducer or a POLY wiring used as the gate wiring of a logic circuit, and simultaneously, apply the conventional manufacturing process to the logic circuit without increasing the number of processes of forming the substrate. In this method, the cost of wafer manufacture before individual substrates are formed is the same as before. Hence, it is possible to arrange a fuse ROM on a head substrate while suppressing the cost.

However, to print a high-quality image, the density of circuits in the head substrate is already high, and melting the fuse ROM may damage their functions. For this reason, any other circuit cannot be formed, e.g., on, under, and near the fuse ROM.

To melt or read-access a plurality of fuse ROMs, means for selecting one of them is necessary. To select a fuse RON as one method, a wiring connected to a fuse ROM connects to the outside of the head substrate to select the fuse ROM from the outside. In this case, electrode pads equal in number to fuse ROMs are necessary on the head substrate to electrically connect them to external wirings. The amount of data to be stored in the fuse ROMs after manufacturing and assembling the printhead is several ten bits, although it is not a large amount. To ensure pads to input/output such information on the head substrate, a considerable space is necessary, resulting in a bulky head substrate. In addition, the number of wirings outside the head substrate also increases in correspondence with the number of pads.

FIG. 20 is a view showing the layout of a conventional head substrate.

As shown in FIG. 20, many conventional head substrates have a large ink supply port H1102 to supply ink from the back surface side to the front surface side of the substrate. For this reason, it is necessary to lay out, on the head substrate, electrothermal transducers, driving elements H1116 to drive electrothermal transducers H1103, and selection circuits (AND circuits) H1112 to select the driving elements while avoiding the ink supply port. An optimum layout is required even in mounting the fuses and their associated circuits on the head substrate.

The present invention has been made to solve the above-described problems, and has as its object to provide a head substrate having a storage element such as a fuse ROM, a printhead using the head substrate, a head cartridge using the printhead, and a printing apparatus using the printhead or head cartridge without increasing the head substrate size.

Means of Solving the Problems

In order to achieve the above object, a head substrate according to the present invention has the following arrangement.

More specifically, a head substrate comprises: an ink supply port which has a long hole shape elongated in a first direction; a plurality of printing elements arrayed along the first direction on both sides of the ink supply port; a plurality of first driving elements, arrayed along the first direction at positions spaced apart further away from the ink supply port than the plurality of printing elements, for driving the plurality of printing elements; a plurality of fuse ROMs for storing information; a plurality of second driving elements for driving the plurality of fuse ROMs; and a shared signal line used for driving the plurality of first driving elements and the plurality of second driving elements, wherein the first driving elements and the second driving elements are arrayed on both sides of an extension of the ink supply port.

Note that the plurality of second driving elements are preferably arranged at both ends of each array of the plurality of first driving elements.

Further mote that the plurality of fuse ROMs are preferably arranged in any of the following regions:

(1) an intermediate region which is sandwiched between extensions of the first driving elements on both sides of the ink supply port;

(2) in addition to (1), a region which is defined between the plurality of second driving elements; and (3) a region which is defined adjacent to arrays of the plurality of printing elements, and between the plurality of second driving elements opposing the ink supply port.

Note that it is preferable in (2) and (3) arrangements that an external terminal commonly connects to a plurality of fuses included in the plurality of fuse ROMs.

Preferably, the head substrate further comprises a plurality of selection circuits, which are arrayed along the first direction at positions spaced apart further away from the ink supply port than the plurality of first driving elements and the plurality of second driving elements, for selectively driving the plurality of first driving elements and the plurality of second driving elements.

In the above arrangement, it is preferable that the plurality of printing elements comprise electrothermal transducers, and printing is executed by energizing the electrothermal transducers to generate heat and discharging ink by using the generated heat.

The head substrate having the above arrangement might further comprise a plurality of sets of the ink supply port, the plurality of printing elements, the plurality of first driving elements, the plurality of fuse ROMs, the plurality of second driving elements, and the shared signal line in correspondence with the number of inks to be used for printing.

Note that the plurality of fuse ROMs store information unique to a head.

A ground wiring of the plurality of printing elements and a ground wiring of the plurality of fuse ROMs are preferably a shared wiring.

According to another aspect of the invention, there is provided a printhead comprising a head substrate having the above arrangement, and a member to form an ink channel provided on the substrate.

The member to form the ink channel is preferably comprised of a resin layer, and a plurality of fuse ROMs are preferably provided closer to a side of an end of the head substrate than a removed part of the resin layer.

According to still another aspect of invention, there is provided an ink cartridge having the printhead and an ink tank which stores ink to be supplied to the printhead.

According to yet another aspect of the invention, there is provided a printing apparatus which prints by using a printhead or head cartridge with the above arrangement.

Effects of the Invention

Hence, according to the present invention, the plurality of first driving elements to drive the plurality of printing elements and the plurality of second driving elements to drive the plurality of fuse ROMs are arranged at appropriate positions, and the common signal line is used to drive these elements. This allows to efficiently use the space on the head substrate and prevent any increase in the head substrate size.

The utilization efficiency of the space on the head substrate can increase by arranging the plurality of fuse ROMs as in, e.g., claims 3 to 5.

Other features and advantages of the present invention will be apparent from the following descriptions taken in conjunction with the accompanying drawings, in which like reference characters designate the same or similar parts throughout the figures thereof.

BRIEF DESCRIPTION OF DRAWINGS

The accompanying drawings, which are incorporated in and constitute a part of the specification, illustrate embodiments of the invention and, together with the description, serve to explain the principles of the invention.

DESCRIPTION OF THE REFERENCE NUMERALS

H1000, H1001 printhead cartridge
H1100, H1101 printhead
H1102 ink supply port
H1103 electrothermal transducer
H1104 electrode
H1105 bump
H1106 ink channel wall
H1107 orifice
H1108 orifice group
H1110 head substrate
H1111 resistance for readout
H1116 driving element
H1117 fuse
H1200, H1201 ink supply port
H1300, H1301 electric wiring tape
H1302 external signal input terminal
H1303 opening
H1304 electrode terminal
H1500, H1501 ink supply holding member
H1560 attachment guide
H1570, H1580, H1590 butt portion
H1600, H1601, H1602, H1603 ink absorber
H1700, H1701, H1702, H1703 filter
H1800, H1801 seal member
H1900 lid member

BEST MODE FOR CARRYING OUT THE INVENTION

Preferred embodiments of the present invention will be described below in detail with reference to the accompanying drawings.

In this specification, the term "print" (also referred to as "printing") not only includes the formation of significant information such as characters and graphics, but also broadly includes the formation of images, figures, patterns, and the like on a printing medium, or the processing of the medium, regardless of whether they are significant or insignificant and whether they are so visualized as to be visually perceivable by humans.

Also, the term "printing medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid") should be extensively interpreted similar to the definition of "print (printing)" described above. That is, "ink" includes a liquid which, when applied onto a printing medium, can form images, figures, patterns, and the like, can process the printing medium, and can process ink (e.g., can solidify or insolubilize a coloring agent contained in ink applied to the printing medium).

Furthermore, unless otherwise stated, the term "nozzle" generally means a set of a discharge orifice, a liquid channel connected to the orifice and an element to generate energy utilized for ink discharge.

A printhead substrate (head substrate) indicates not a simple base made of silicon semiconductor but a structure including elements and wirings.

"On a substrate" indicates not only the upper side of a head substrate but also the upper surface of the head substrate and the inside of the head substrate near the upper surface. In the present invention, a term "built-in" indicates not simply separately arranging individual elements on the upper surface of a base but also integrally forming and manufacturing individual elements on an element substrate by, e.g., semiconductor circuit manufacturing steps.

<Basic Arrangement of Printing Apparatus (FIGS. 1 and 2)>

Figure 1:
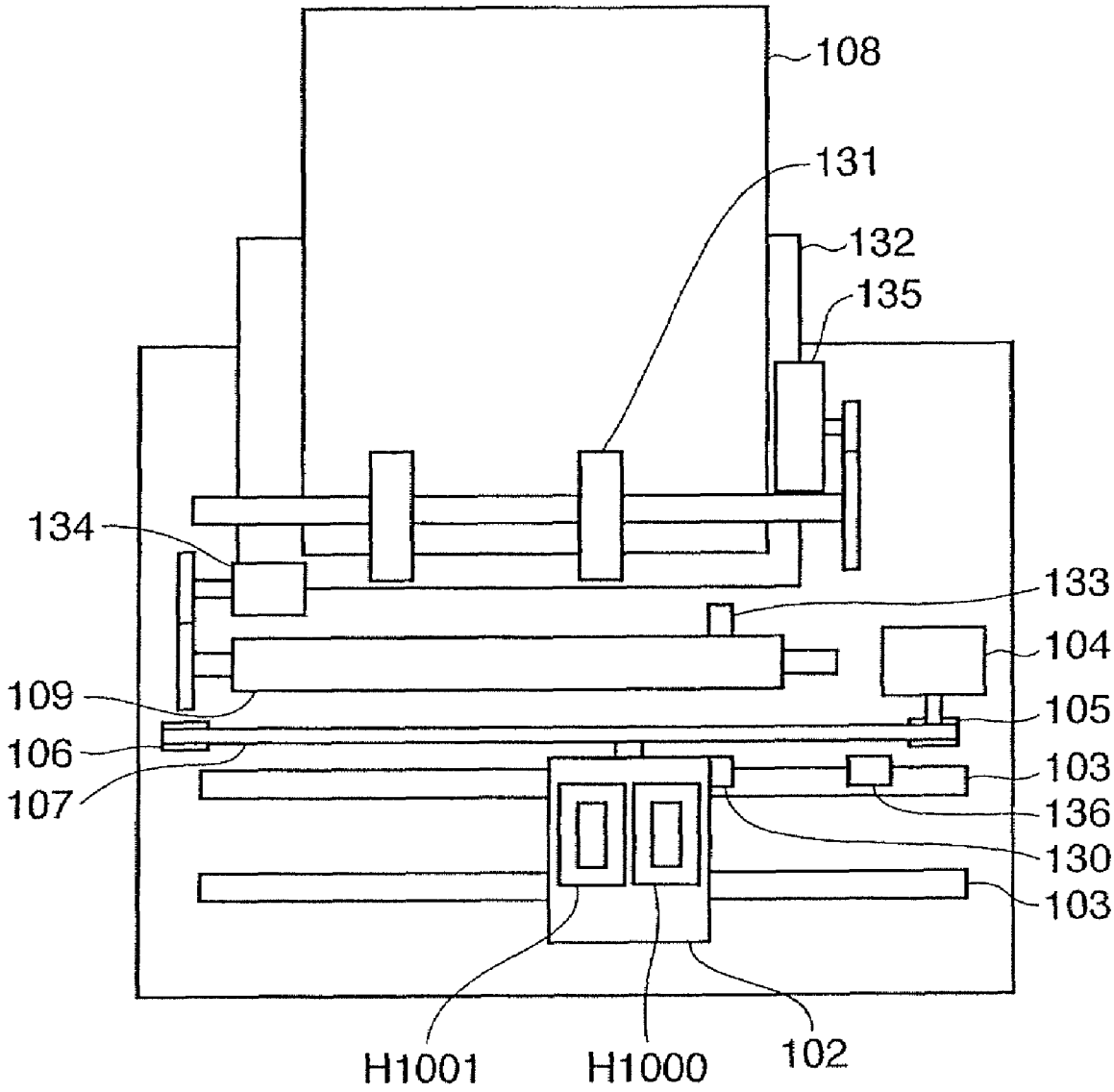
FIG. 1 is an explanatory view showing an example of a printing apparatus capable of including an inkjet printhead of the present invention.

FIG. 1 is an explanatory view showing an example of a printing apparatus capable of including an inkjet printhead or inkjet printhead cartridge (to be referred to as a printhead or printhead cartridge hereinafter) of the present invention.

As shown in FIG. 1, the printing apparatus has a carriage 102 having printhead cartridges H1000 and H1001 (to be described below) positioned and exchangeably mounted. The carriage 102 has an electrical connection portion to transmit driving signals to discharge portions through external signal input terminals on the printhead cartridges H1000 and H1001.

The carriage 102 is supported along a guide shaft 103 to be reciprocally movable. The guide shaft 103 runs in the main scanning direction in the apparatus main body. A carriage motor 104 drives the carriage 102 via a driving mechanism including a motor pulley 105, driven pulley 106, and timing belt 107 and controls the position and movement of the carriage 102. The carriage 102 has a home position sensor 130. The home position sensor 130 on the carriage 102 detects the home position when passing through the position of a shielding plate 136.

A feed motor 135 rotates pickup rollers 131 through a gear to separately feed each printing medium 108 on an automatic sheet feeder (ASF) 132. A conveyance roller 109 rotates to convey the printing medium 108 through a position (printing position) facing the orifice surfaces of the printhead cartridges H1000 and H1001. This conveyance direction is called a sub-scanning direction. Driving by a conveyance motor 134 is transmitted to the conveyance roller 109 through a gear. When the printing medium 108 passes through a paper end sensor 133, whether or not a paper sheet has been fed is determined, and the edge position in paper feeding is determined. The paper end sensor 133 is also used to determine the actual trailing edge position of the printing medium 108 and finally detect the current printing position from the actual trailing edge position.

A platen (not shown) supports the back surface of the printing medium 108 to form a flat print surface in the printing position. In this case, the printhead cartridges H1000 and H1001 mounted on the carriage 102 are held between two pairs of conveyance rollers to be parallel to the printing medium 108 while making the orifice surfaces projecting downward from the carriage 102.

The printhead cartridges H1000 and H1001 are mounted on the carriage 102 while making the array direction of orifices of each discharge portion intersect the scanning direction (main scanning direction) of the carriage 102. The printhead cartridges H1000 and H1001 discharge ink from the orifice arrays to print.

If a printhead cartridge having the same structure as that of the printhead cartridge H1001 and including light magenta, light cyan, and black inks replaces the printhead cartridge H1000, the printing apparatus can also serve as a high-quality photo printer.

A control arrangement to execute print control of the above-described printing apparatus will be described next.

Figure 2:
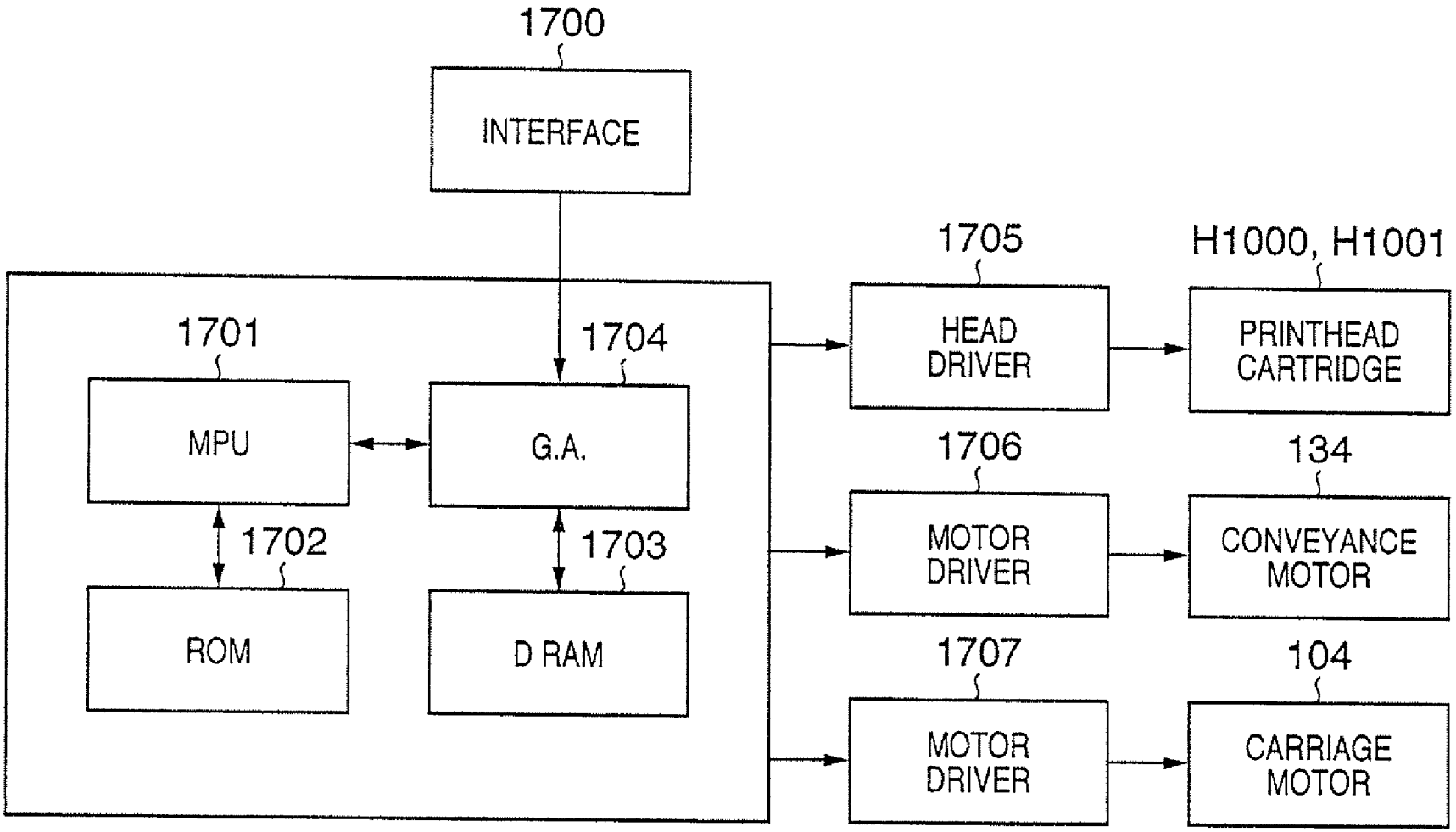
FIG. 2 is a block diagram showing the arrangement of the control circuit of the printing apparatus.

FIG. 2 is a block diagram showing the arrangement of the control circuit of the printing apparatus.

Referring to FIG. 2, reference numeral 1700 denotes an interface to input a printing signal; 1701, an MPU; 1702, a ROM that stores control programs to be executed by the MPU 1701; and 1703, a DRAM that saves various kinds of data (e.g., the printing signal and printing data to be supplied to the printhead cartridges). A gate array (G.A.) 1704 controls supply of printing data to the printhead cartridges H1000 and H1001. The gate array 1704 also controls data transfer between the interface 1700, MPU 1701, and RAM 1703.

A motor driver 1706 drives the conveyance motor 134. A motor driver 1707 drives the carriage motor 104.

The operation of the control arrangement will be described. A printing signal that has entered the interface 1700 is converted into printing data between the gate array 1704 and the MPU 1701. The motor drivers 1706 and 1707 are driven. The printhead cartridges H1000 and H1001 are driven in accordance with the printing data sent to the carriage 102 to print an image on the printing medium 108.

To optimally drive the printing element portions of the printhead cartridges H1000 and H1001, the driving method of each printing element is determined by referring to characteristic information held in the fuse ROMs of the head substrate (to be described later).

<Structure of Printhead (FIGS. 3 to 8)>

Figure 3:
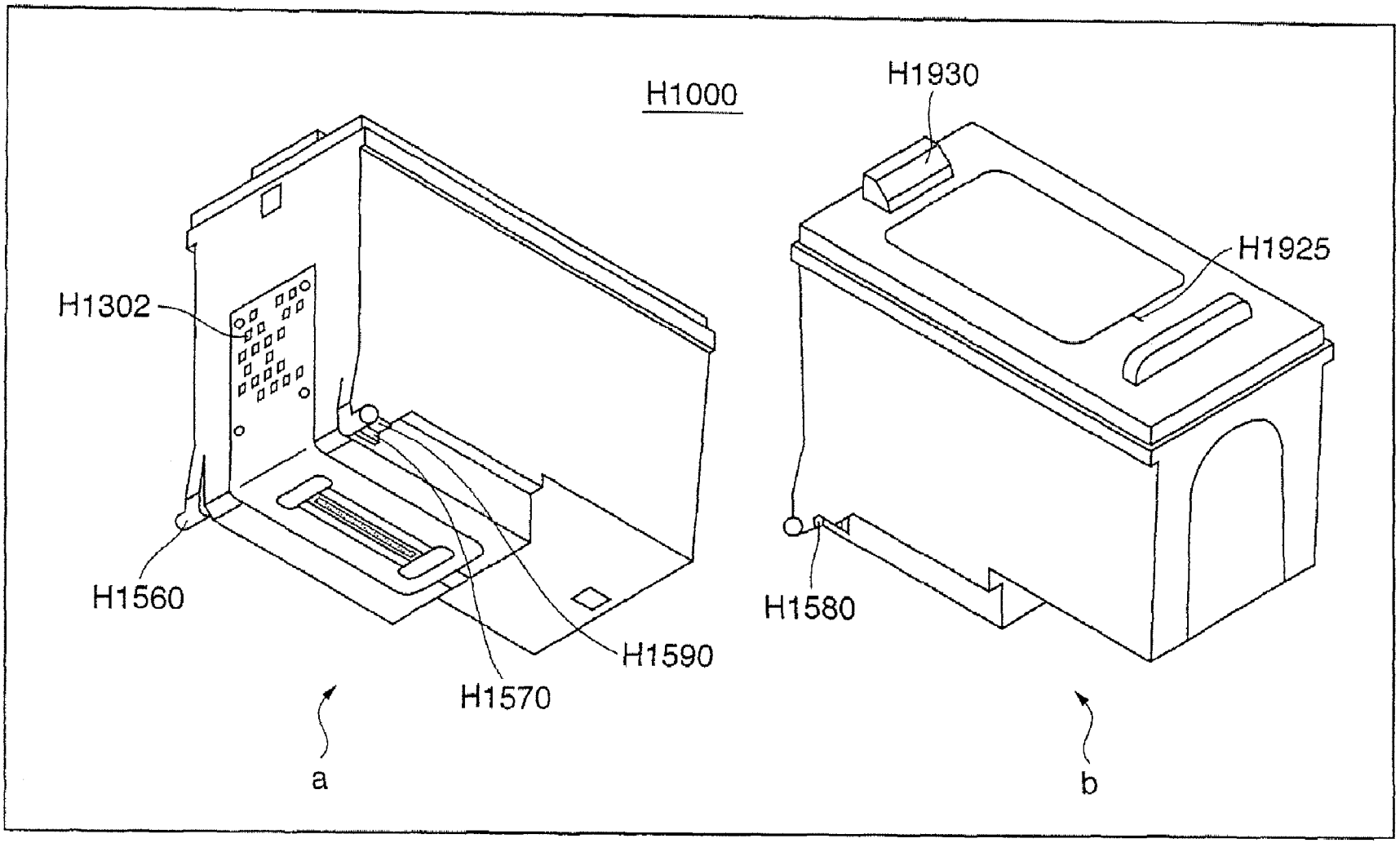
FIG. 3 is a perspective view showing the structure of a printhead cartridge H1000.
Figure 6:
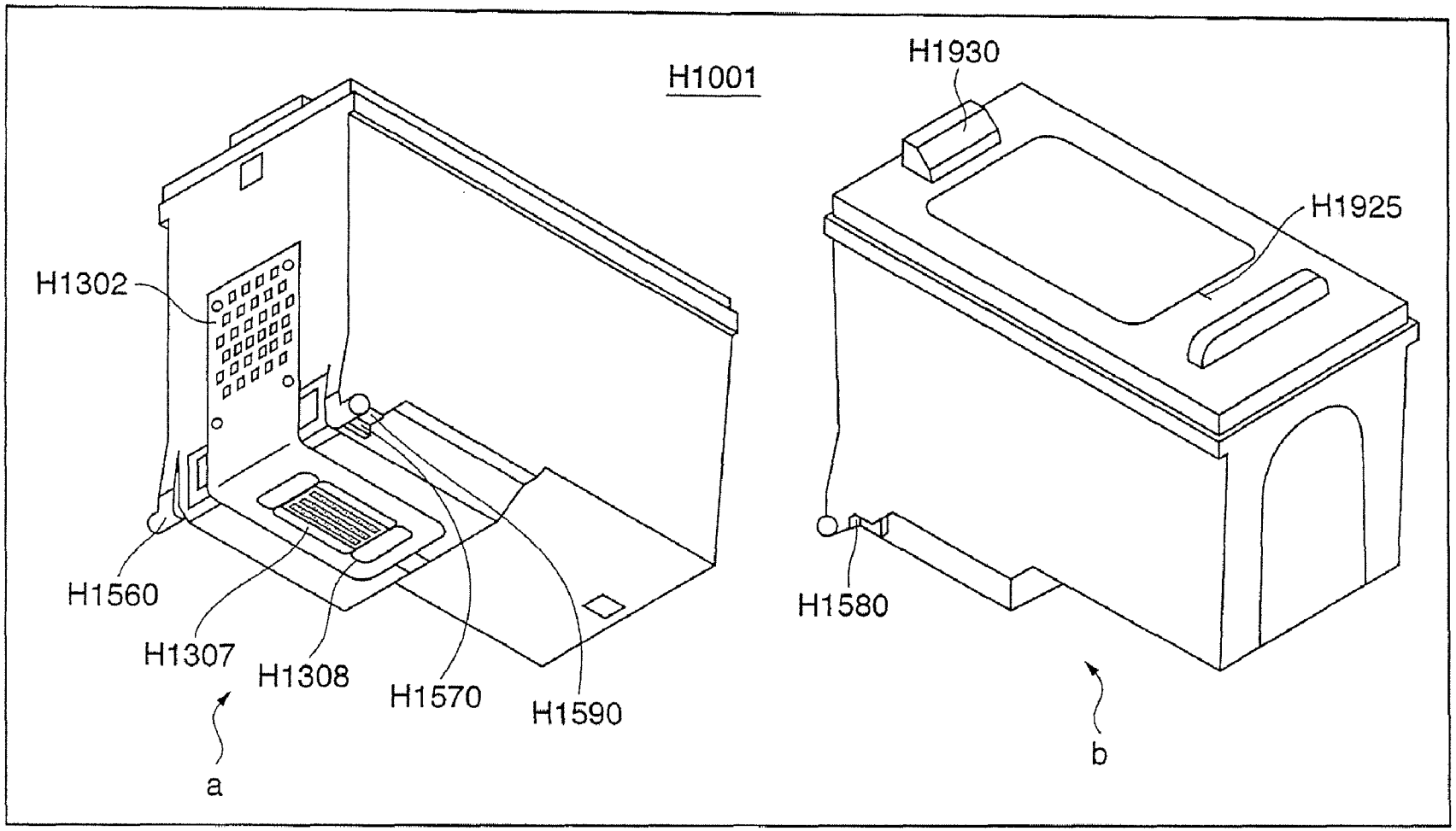
FIG. 6 is a perspective view showing the structure of a printhead cartridge H1001.

FIG. 3 is a perspective view showing the structure of the printhead cartridge H1000. FIG. 6 is a perspective view showing the structure of the printhead cartridge H1001.

As shown in FIGS. 3 and 6, a printhead cartridge mounted on the printing apparatus according to this embodiment is a cartridge integrated with an ink tank and includes the printhead cartridge H1000 filled with black ink, as shown in FIGS. 3-*a* and 3-*b*, and the printhead cartridge H1001 filled with color inks (cyan ink, magenta ink, and yellow ink), as shown in FIGS. 6-*a* and 6-*b*. The printhead cartridges H1000 and H1001 are fixedly supported on the carriage 102 of the printing apparatus by positioning means and an electrical contact and are also detachable from the carriage 102. If the contained inks run out, the printhead cartridge can be exchanged.

The constituent elements of the printhead cartridges H1000 and H1001 will be described below in detail.

Each of the printhead cartridges H1000 and H1001 is a printhead having electrothermal transducers that generate thermal energy to cause film boiling in accordance with an electrical signal. The printhead cartridge has a so-called side-shooter printhead in which electrothermal transducers face ink orifices.

[Printhead Cartridge H1000]

Figure 4:
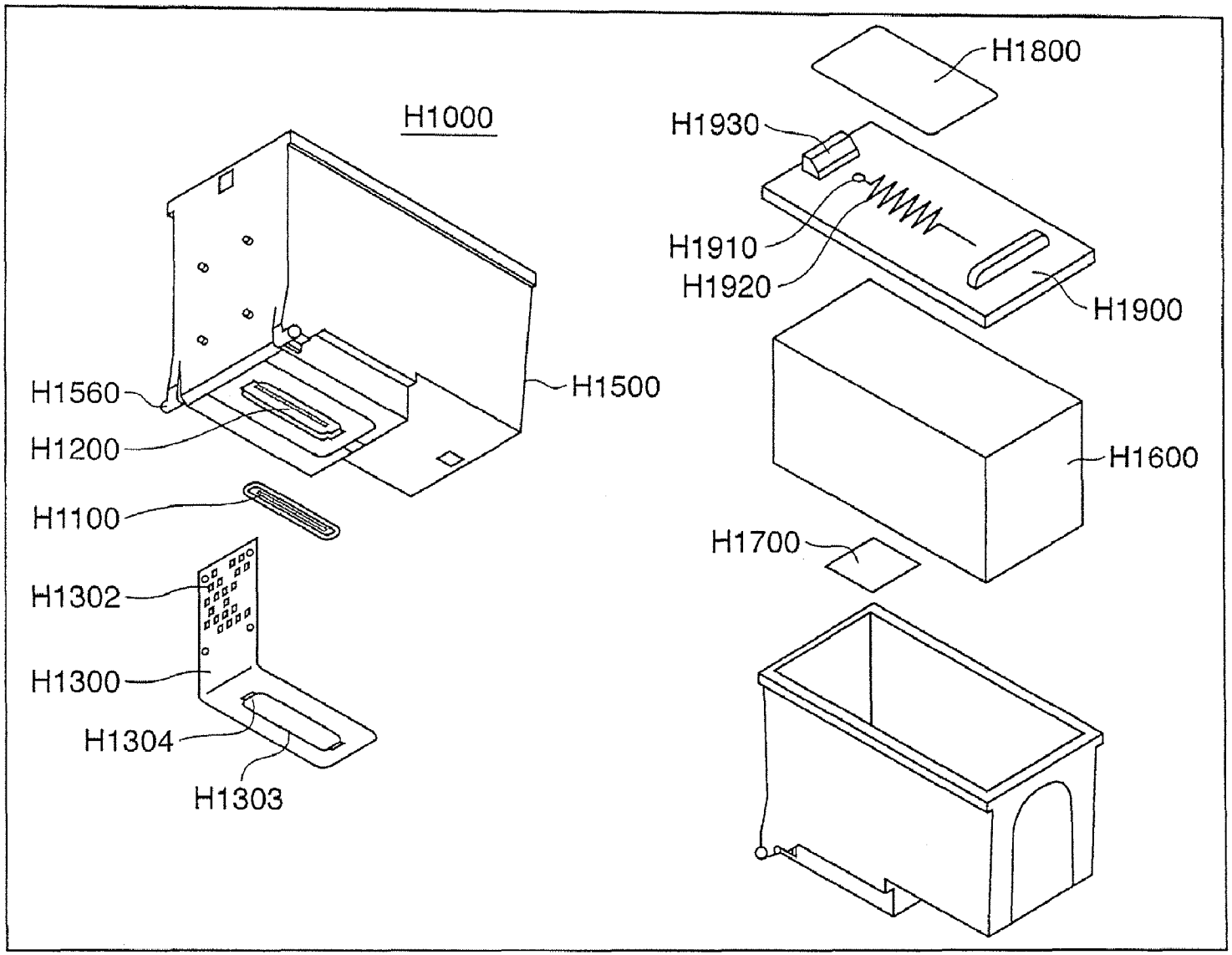
FIG. 4 is an exploded perspective view of the printhead cartridge H1000.

FIG. 4 is an exploded perspective view of the printhead cartridge H1000. The printhead cartridge H1000 includes a printhead H1100, electric wiring tape H1300, ink supply holding member H1500, filter H1700, ink absorber H1600, lid member H1900, and seal member H1800.

Printhead H1100

Figure 5:
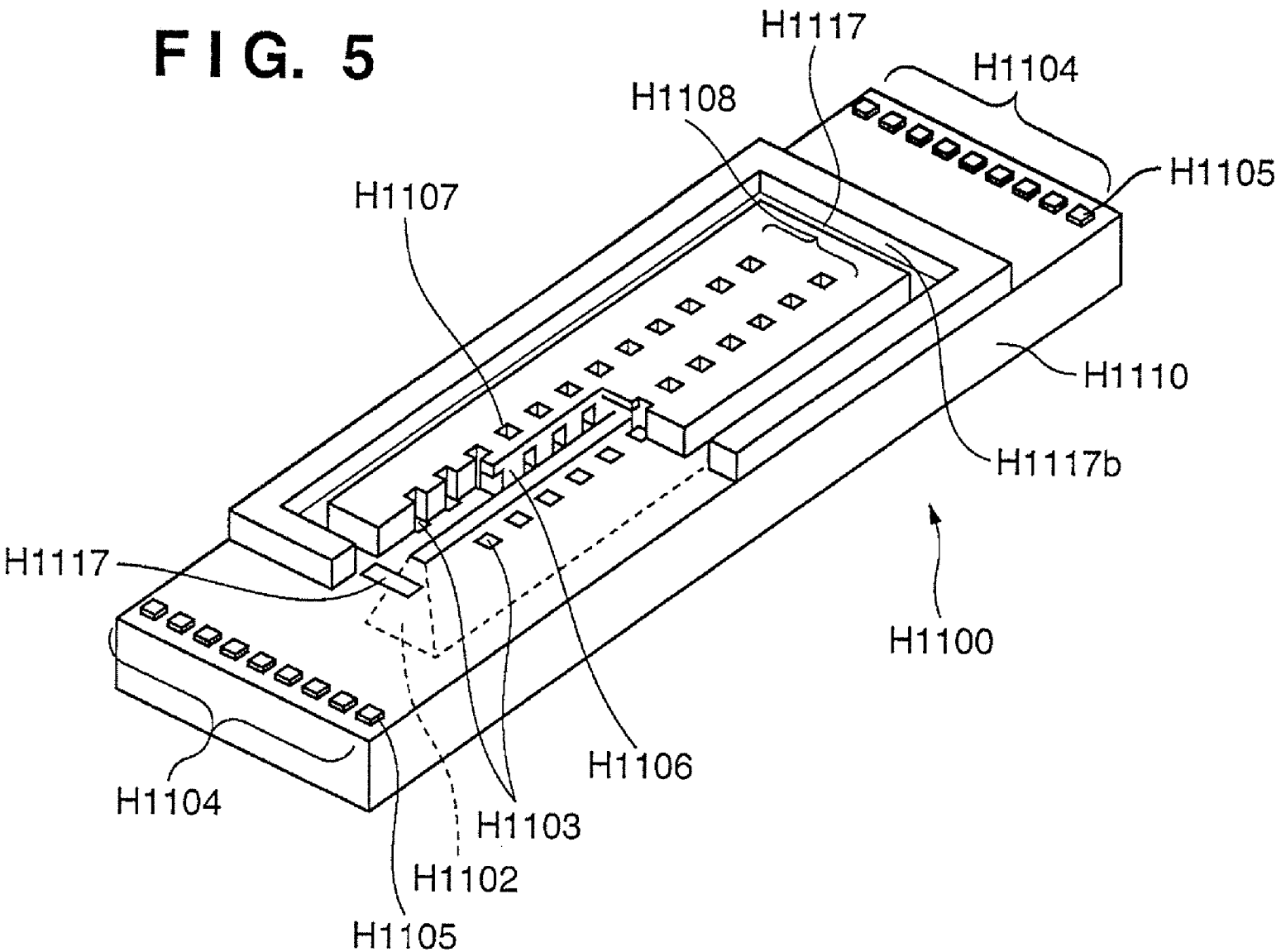
FIG. 5 is a partially cutaway perspective view for explaining the structure of a printhead H1100.

FIG. 5 is a partially cutaway perspective view for explaining the structure of the printhead H1100. The printhead H1100 includes a head substrate H1110 that is made of, e.g., a 0.5 to 1 mm thick Si substrate having an ink supply port H1102 serving as a through hole to flow ink from the lower surface of the substrate.

On the head substrate H1110, electrothermal transducers H1103 are arrayed along the ink supply port H1102 on its both sides (in this embodiment, an array of electrothermal transducers is arranged on each side of the ink supply port). In addition, electric wirings (not shown) made of, e.g., aluminum (Al) to supply power to the electrothermal transducers H1103 are arranged while being spaced apart from the ink supply port H1102 by a predetermined distance. It is possible to form the electrothermal transducers H1103 and electric wirings by using a conventional film formation technique. In this embodiment, the electrothermal transducers H1103 of the arrays on both sides of the ink supply port have a staggered pattern. That is, the positions of orifices H1107 of the two arrays slightly shift without being located on one line in a direction perpendicular to the arrays.

It goes without saying that the present invention incorporates any structure except the staggered pattern.

Electrodes H1104 to supply, to the electric wirings, power or an electrical signal to drive the electrothermal transducers H1103 are arranged on the head substrate H1110 while being arrayed along the sides located at the two ends of each array of the electrothermal transducers H1103. Each electrode H1104 may have a bump H1105 made of, e.g., Au.

On the surface of the head substrate H1110 having a pattern of storage elements including the wirings and electrothermal transducers H1103, a structure made of resin material is formed by photolithography to form ink channels corresponding to the electrothermal transducers H1103. This structure has an ink channel wall H1106 to partition the ink channels and a ceiling portion to cover the upper part of the ink channel wall H1106. The orifices H1107 are open to the ceiling portion. The orifices H1107 correspond to the electrothermal transducers H1103, respectively, to form an orifice group H1108.

In the printhead H1100 having the above-described structure, ink supplied from the ink supply port H1102 is discharged from the orifices H1107 facing the electrothermal transducers H1103 by the pressure of bubbles created by the heat from the electrothermal transducers H1103.

Electric Wiring Tape H1300

The electric wiring tape H1300 forms an electrical signal path to apply an electrical signal to the printhead H1100 to discharge ink. The electric wiring tape H1300 has an opening H1303 to set the printhead H1100 in it. The electric wiring tape H1300 also has external signal input terminals H1302 to receive an electrical signal from the printing apparatus. The external signal input terminals H1302 and electrode terminals H1304 are coupled by an interconnection pattern of a continuous copper foil.

For example, when the bumps H1105 formed on the electrodes H1104 of the printhead H1100 join to the electrode terminals H1304 of the electric wiring tape H1300 corresponding to the electrodes H1104 of the printhead H1100, electrical connection between the electric wiring tape H1300 and the printhead H1100 is ensured.

Ink Supply Holding Member H1500

As shown in FIG. 4, the ink supply holding member H1500 implements the function of an ink tank by having the absorber H1600 to hold ink inside and generate negative pressure and the ink supply function by forming an ink channel to guide the ink to the printhead H1100.

The ink supply holding member H1500 has an ink supply port H1200 to supply black ink to the printhead H1100. The printhead H1100 is accurately bonded to the ink supply holding member H1500 to make the ink supply port H1102 (FIG. 5) of the printhead H1100 communicate with the ink supply port H1200 of the ink supply holding member H1500.

Lid Member H1900

The lid member H1900 has a fine port H1910 to let a pressure variation in the ink supply holding member H1500 relax and a fine groove H1920 communicating with the fine port H1910. The seal member H1800 covers most part of the fine port H1910 and fine groove H1920 while keeping one end of the fine groove H1920 open, thereby forming an air communicating port H1925 (FIG. 3). The lid member H1900 has an engaging portion H1930 to fix the printhead cartridge H1000 to the printing apparatus.

[Printhead Cartridge H1001]

Figure 7:
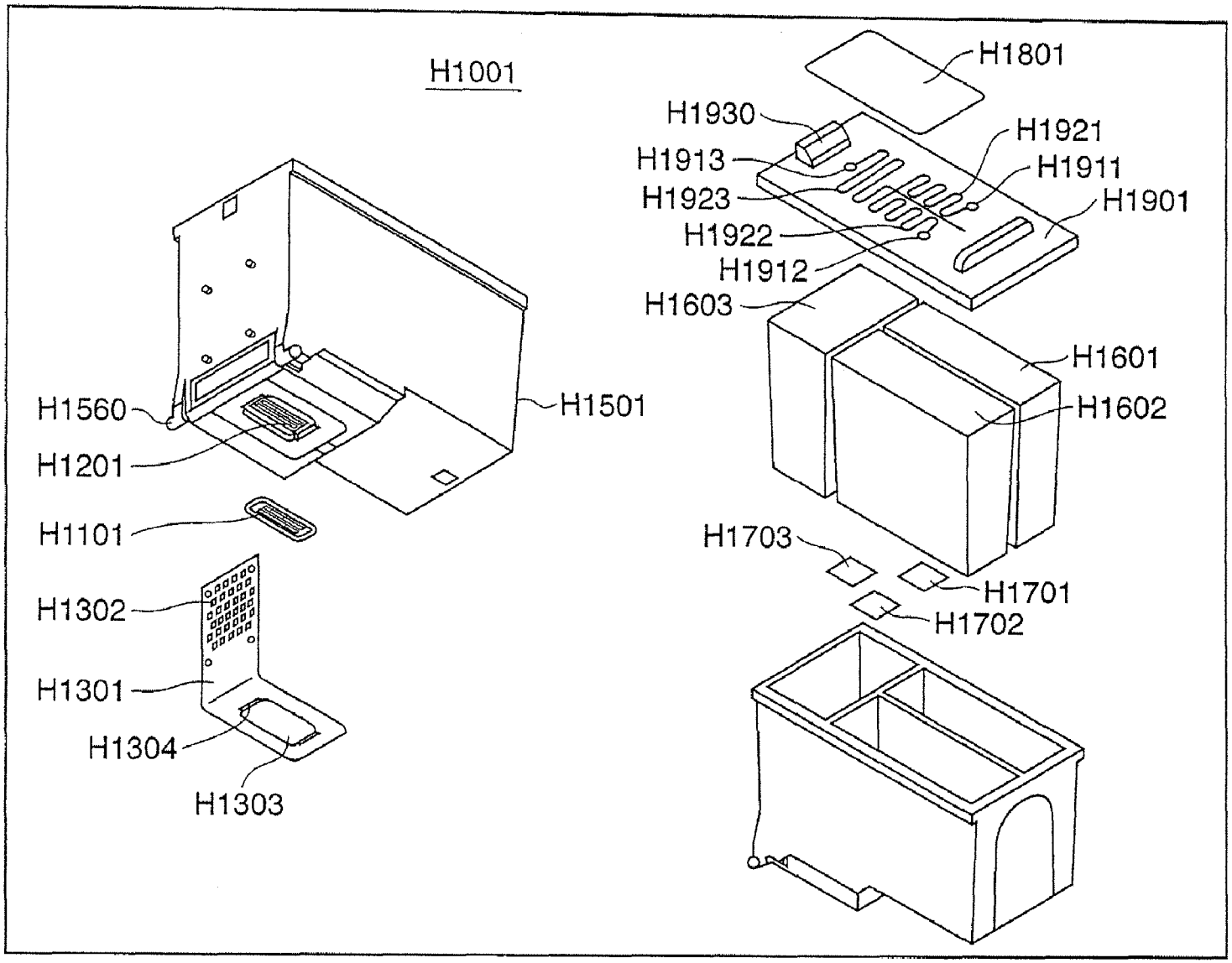
FIG. 7 is an exploded perspective view of the printhead cartridge H1001.

FIG. 7 is an exploded perspective view of the printhead cartridge H1001. The printhead cartridge H1001 discharges inks of three colors, i.e., cyan, magenta, and yellow. As shown in FIG. 7, the printhead cartridge H1001 includes a printhead H1101, electric wiring tape H1301, ink supply holding member H1501, filters H1701 to H1703, ink absorbers H1601 to H1603, lid member H1901, and seal member H1801.

Printhead H1101

Figure 8:
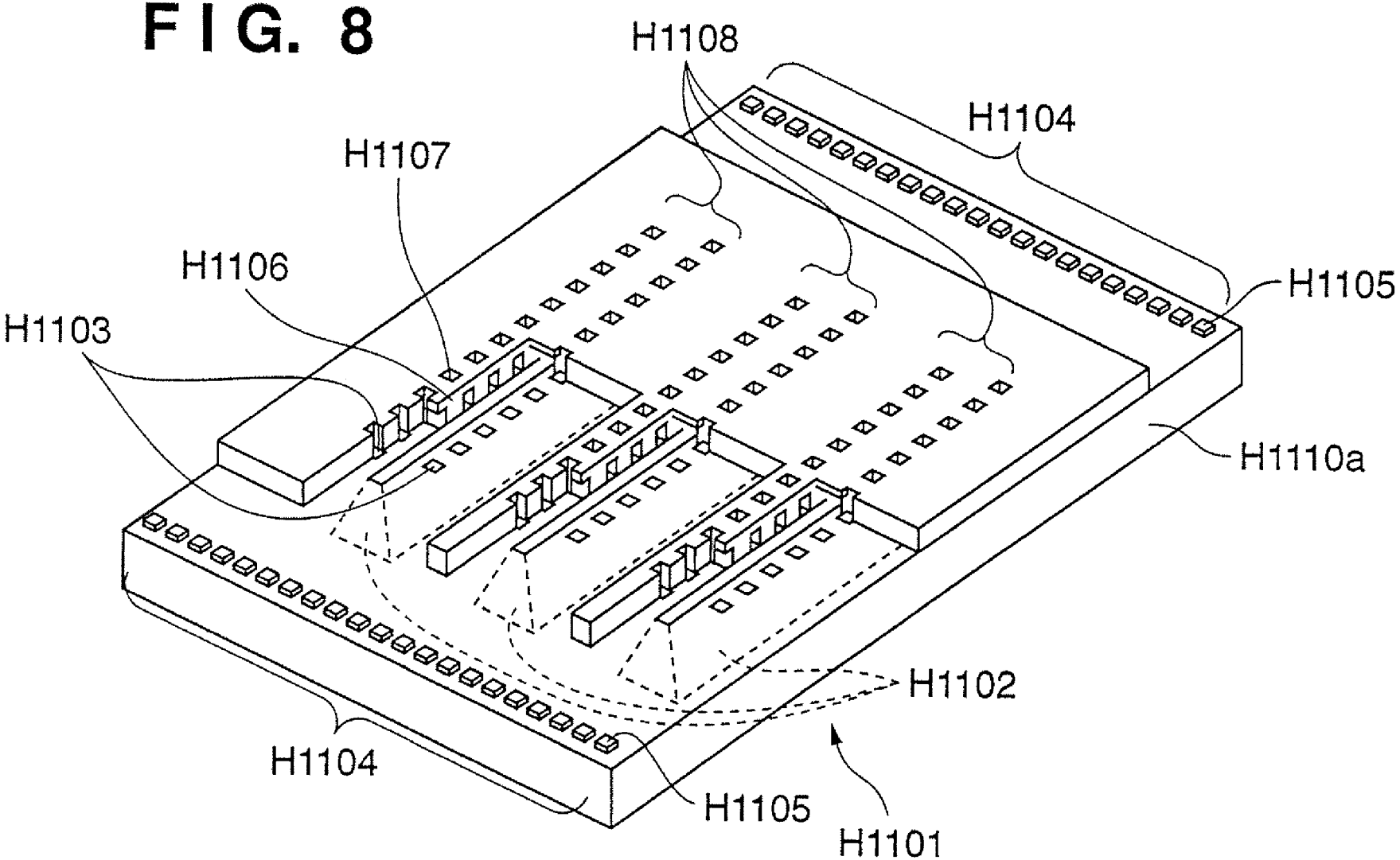
FIG. 8 is a partially cutaway perspective view for explaining the structure of a printhead H1101.

FIG. 8 is a partially cutaway perspective view for explaining the structure of the printhead H1111. The printhead H1101 significantly differs from the printhead H1100 in that three ink supply ports H1102 for cyan, magenta, and yellow are juxtaposed. Arrays of the electrothermal transducers H1103 and orifices H1107 are arranged in a staggered pattern on both sides of each ink supply port H1102, A head substrate H1110*a* has electric wirings, fuse ROMs, resistances, and electrodes, like the head substrate H1110 of the printhead H1100. The ink channel wall H1106 made of resin material and the orifices H1107 are formed on the head substrate H1110*a* by photolithography. Each electrode H1104 to supply power to the electric wirings has the bump H1105 made of, e.g., Au.

Electric Wiring Tape H1301

The electric wiring tape H1301 basically has the same structure as the electric wiring tape H1300, and a description thereof will be omitted.

Ink Supply Holding Member H1501

The ink supply holding member H1501 basically has the same structure and function as the ink supply holding member H1500, and a description thereof will be omitted. The ink supply holding member H1501 has three independent spaces to hold three color inks. The spaces store the ink absorbers H1601 to H1603. The three ink supply ports H1201 provided on the bottom of the ink supply holding member H1501 communicate with the ink supply ports H1102 (see FIG. 8) after assembly.

Lid Member H1901

The lid member H1901 has the same structure as the lid member H1900. The lid member H1901 has fine ports H1911 to H1913 to let a pressure variation in the spaces of ink supply holding member H1501 relax and fine grooves H1921 to H1923 communicating with the fine ports H1911 to H1913.

Attachment of the above-described printheads to the inkjet printing apparatus will be described next in detail.

As shown in FIGS. 3 and 6, each of the printhead cartridges H1000 and H1001 has an attachment guide H1560 to guide the printhead cartridge to the attachment position of the carriage 102 of the printing apparatus, the engaging portion H1930 to attach and fix the printhead cartridge to the carriage by a head set lever, and an X-direction (main scanning direction) butt portion H1570, Y-direction (sub-scanning direction) butt portion H1580, and Z-direction (ink discharge direction) butt portion H1590 to position the printhead cartridge to a predetermined attachment position of the carriage. These butt portions position the printhead cartridge to ensure accurate electrical contact between the external signal input terminals H1302 on the electric wiring tapes H1300 and H1301 and the contact pins of the electrical connection portions provided in the carriage.

<Structure of Contact Pads (FIGS. 9 and 10)>

Printhead Cartridge H1001

Figure 9:
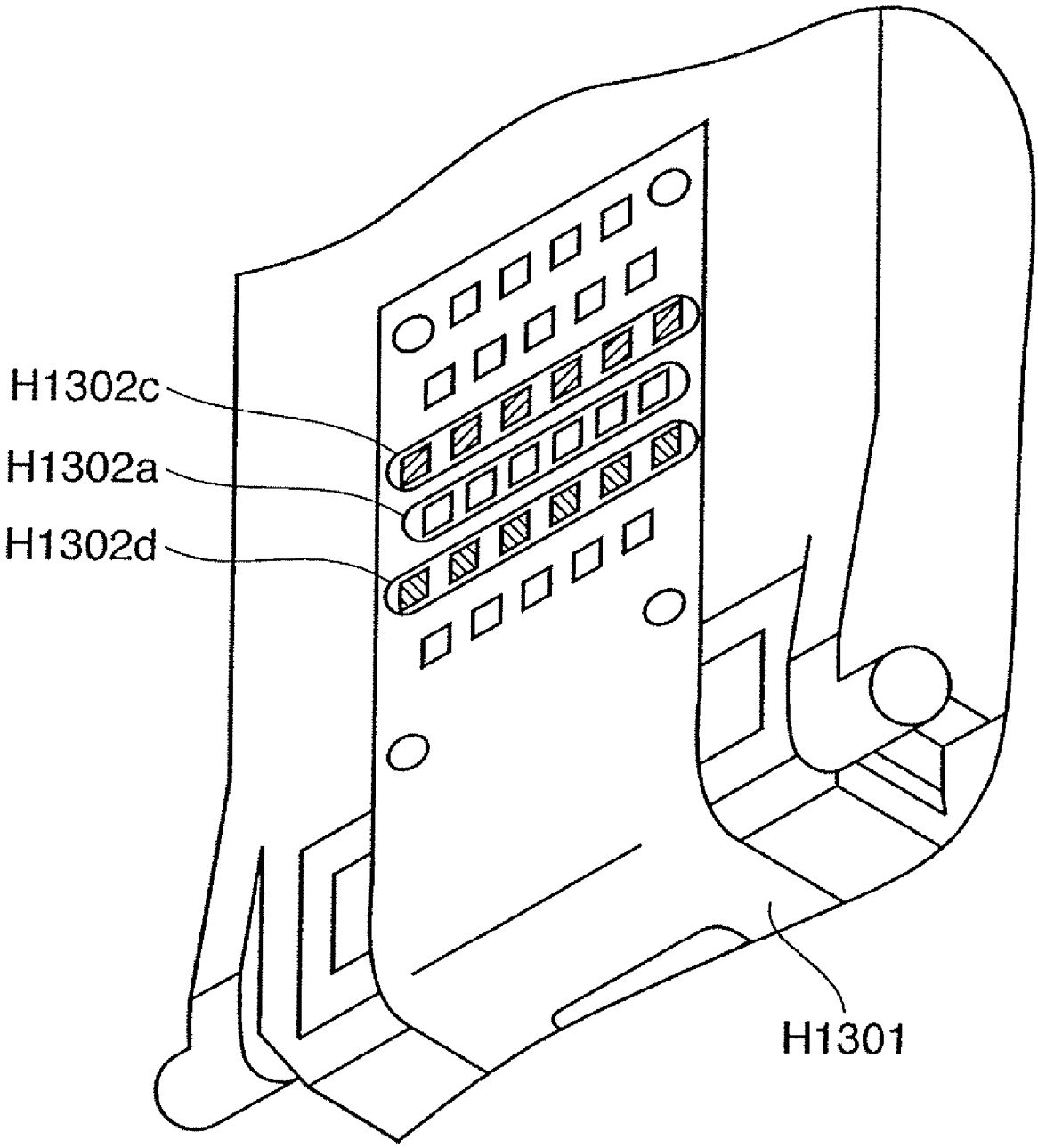
FIG. 9 is an enlarged view of the external signal input terminal portion of an electric wiring tape H1301 of the printhead cartridge H1001.

FIG. 9 is an enlarged view of the external signal input terminal portion of the electric wiring tape H1301 of the printhead cartridge H1001. Referring to FIG. 9, the electric wiring tape H1301 has 32 external signal input terminals H1302. The external signal input terminals H1302 include six ID contact pads H1302*a* which are located almost at the center of the area where the external signal input terminals H1302 are provided. The ID contact pads H1302*a* connect to some of the electrodes H1104 that exist at the two ends of each of the three ink supply ports H1102 of the printhead H1101 shown in FIG. 8.

Six VH contact pads H1302*c* are arranged adjacent to one side (upper side in FIG. 9) of the array of the ID contact pads H1302*a* while being arrayed along them. The VH contact pads H1302*c* connect to some of the electrode pads H1104 at the two ends of the printhead H1101 shown in FIG. 8.

Six GNDH contact pads H1302*d* are arranged adjacent to the other side (lower side in FIG. 9) of the array of the ID contact pads H1302*a* while being arrayed along them. The GNDH contact pads H1302*d* connect to some of the electrode pads H1104 at the two ends of the printhead H1101 shown in FIG. 8.

The remaining external signal input terminals H1302 except the ID contact pads H1302*a*, VH contact pads H1302*c*, and GNDH contact pads H1302*d* are used to supply power for transistors and other signals such as a control signal.

In the printhead cartridge H1001, the ID contact pads H1302*a* relatively sensitive to static electricity are located almost at the center of the external signal input terminals H1302. With this layout, the user who is holding the printhead cartridge H1001 hardly touches the ID contact pads H1302*a*. The user basically holds a printhead while taking precaution not to touch the external signal input terminals H1302. Hence, it is difficult to touch the pads located at the center.

Additionally, the ID contact pads H1302*a* are adjacent to the VH contact pads H1302*c* and GNDH contact pads H1302*d* and are sandwiched between them. If a user puts his/her charged finger nearby the ID contact pads H1302*a* and causes discharge, the discharge readily occurs in the VH contact pads H1302*c* and GNDH contact pads H1302*d*. This structure can therefore almost prevent head specific information from being destroyed or accidentally rewritten by the discharge.

Printhead Cartridge H1000

Figure 10:
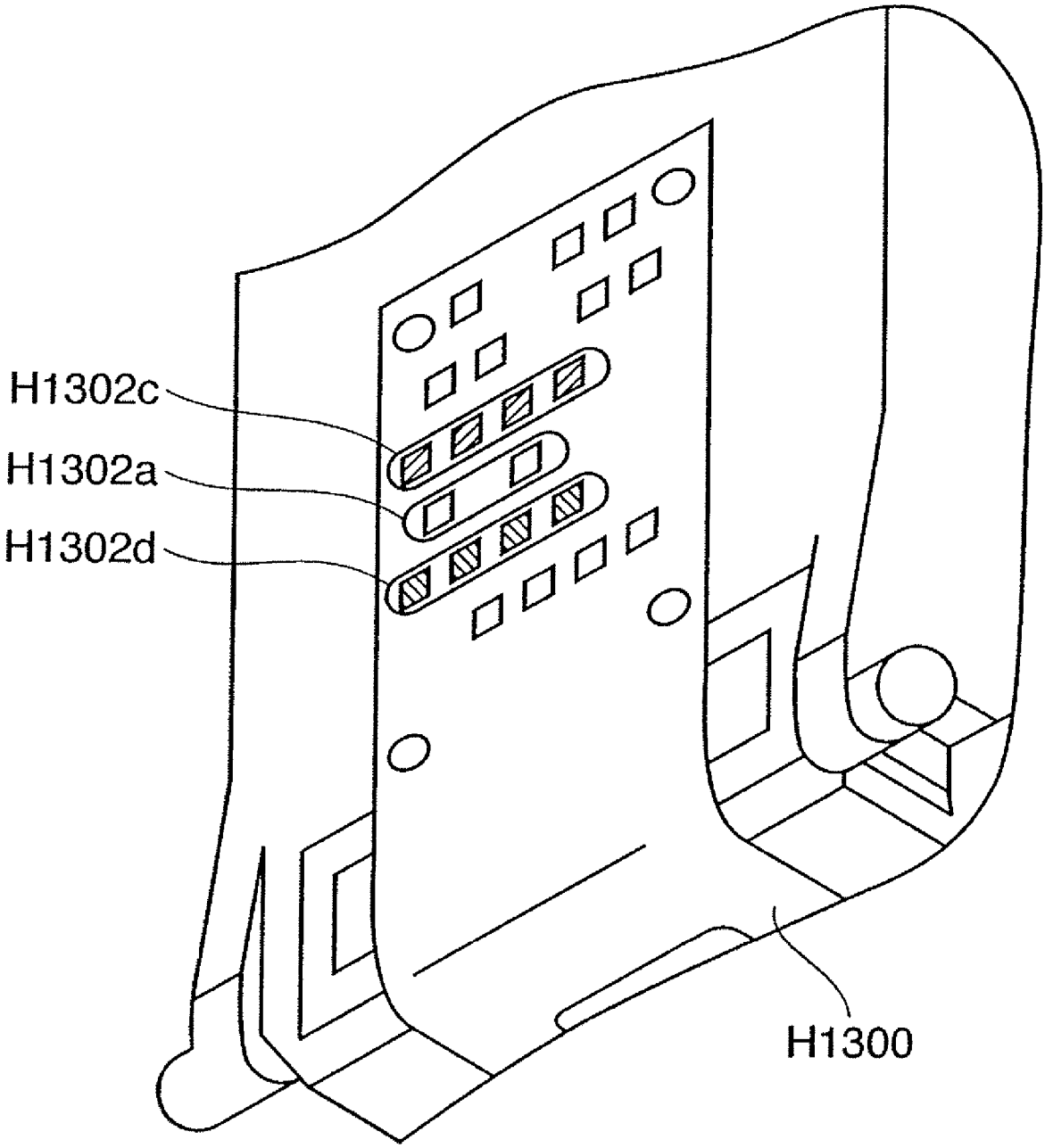
FIG. 10 is an enlarged view of the external signal input terminal portion of an electric wiring tape H1300 of the printhead cartridge H1000.

FIG. 10 is an enlarged view of the external signal input terminal portion of the electric wiring tape H1300 of the printhead cartridge H1000. Referring to FIG. 10, the electric wiring tape H1300 has 21 external signal input terminals H1302. Since the printhead cartridge H1000 is a black ink cartridge, the number of terminals for power supply and control signal is smaller than in the above-described printhead cartridge H1001 for inks of three colors, i.e., cyan, magenta, and yellow. The carriage 102 of the printing apparatus main body is designed such that a photo printhead having the same form as the printhead cartridge H1001 is attachable in place of the printhead cartridge H1000. For this reason, the positions of the 21 external signal input terminals H1302 of the printhead cartridge H1000 correspond to the positions of the external signal input terminals H1302 of the printhead cartridge H1001.

The external signal input terminals H1302 provided on the electric wiring tape H1300 include six ID contact pads H1302*a* which are located almost at the center of the area where the external signal input terminals H1302 are provided. The ID contact pads H1302*a* connect to some of the electrode pads H1104 that exist at the two ends of the ink supply port H1102 of the head substrate H1100 shown in FIG. 5.

Four VH contact pads H1302*c* are arranged adjacent to one side (upper side in FIG. 10) of the array of the ID contact pads H1302*a* while being arrayed along them. The VH contact pads H1302*c* connect to some of the electrode pads H1104 at the two ends of the head substrate H1100 shown in FIG. 5.

Four GNDH contact pads H1302*d* are arranged adjacent to the other side (lower side in FIG. 10) of the array of the ID contact pads H1302*a* while being arrayed along them. The GNDH contact pads H1302*d* connect to some of the electrode pads H1104 at the two ends of the head substrate H1100 shown in FIG. 5.

The remaining external signal input terminals H1302 except the ID contact pads H1302*a*, VH contact pads H1302*c*, and GNDH contact pads H1302*d* are used to supply power for transistors and other signals such as a control signal.

Even in the printhead cartridge H1000, the ID contact pads H1302*a* relatively sensitive to static electricity are located almost at the center of the external signal input terminals H1302, like the printhead cartridge H1001. With this layout, the user who is holding the printhead cartridge H1000 hardly touches the ID contact pads H1302*a*.

Additionally, the ID contact pads H1302*a* are adjacent to the VH contact pads H1302*c* and GNDH contact pads H1302*d* and are sandwiched between them. If a user puts his/her charged finger nearby the ID contact pads H1302*a* and causes discharge, this structure can almost prevent head specific information from being destroyed or accidentally rewritten by the discharge.

Several embodiments of the structure of the head substrate applied to the printing apparatus and printhead having the above-described arrangements will be described next.

First Embodiment

Figure 11:
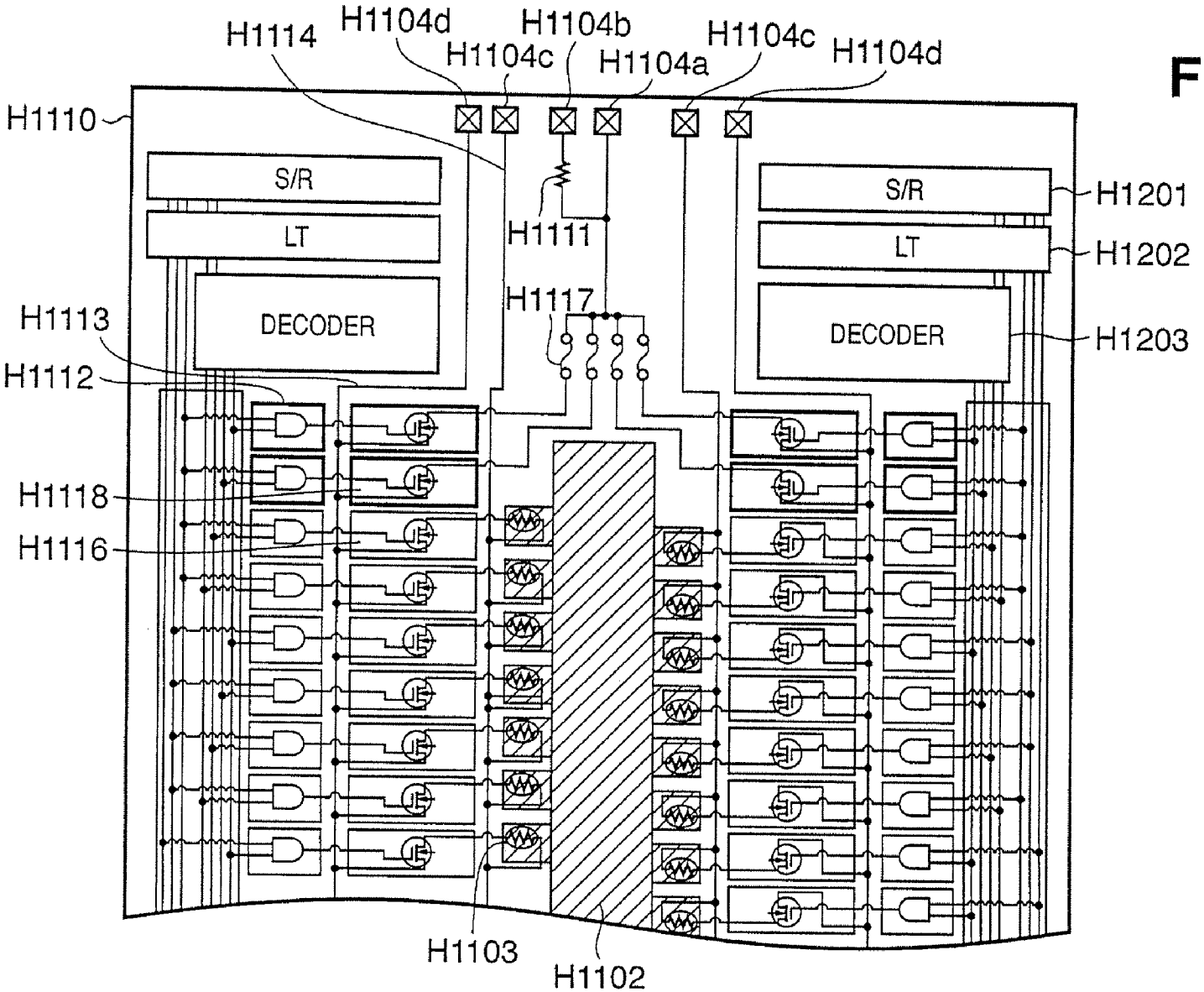
FIG. 11 is a view showing the layout of a head substrate H1110 according to the first embodiment.

FIG. 11 is a view showing the layout of a head substrate according to the first embodiment. A printhead H1100 has a head substrate H1110 having semiconductor elements and wirings formed, by a semiconductor process, on a base made of silicon (Si).

As shown in FIG. 11, the head substrate H1110 has fuse ROMs to store information (e.g., the head type, ink discharge characteristic, head individual identification information, use state, and ink consumption) unique to the head and necessary peripheral circuits. FIG. 11 shows part of the head substrate.

Referring to FIG. 11, a long ink supply port H1102 is formed in the silicon base. The long ink supply port can be of a rectangular, oblong, or elliptic shape. The ink supply port need only be an elongated opening capable of supplying ink in the longitudinal direction of the substrate.

Electrothermal transducers H1103 such as resistors that form printing elements are arrayed on both sides of the ink supply port. In FIG. 11, the electrothermal transducers H1103 on both sides of the ink supply port are arranged in a staggered pattern. However, they may be located without shift or need not always be arranged linearly.

Driving elements H1116 to drive the electrothermal transducers H1103 are arrayed at positions spaced apart further away from the ink supply port than the electrothermal transducers. Signal lines that supply signals to selectively drive the electrothermal transducers are arranged closer to the side of an end (an end of the long side of the substrate) of the substrate than the arrangement region of the driving elements H1116.

Reference numeral H1117 denotes a fuse ROM. In this example, four fuse ROMs H1117 each including a polysilicon resistor are arranged in the space on the extension of the ink supply port H1102. It is difficult to provide the circuits and wirings to drive the electrothermal transducers in the area near the ink supply port on its extension because of avoiding the ink supply port. This region having neither circuits nor wirings is usable to arrange the fuses close to each other while achieving space-saving.

In this embodiment, the fuse includes a polysilicon resistor. Instead, the fuse may include a metal film such as Al or a resistor made of the same material as that of the resistor of the printing element. This structure is more desirable because the fuses and electrothermal transducers can be formed in the same film formation step.

Each fuse ROM H1117 connects to a driving element H1118 to melt the fuse and read out information from it. The driving elements H1118 are arranged on both sides of the extension of the ink supply port at positions adjacent to the other driving elements H1116 for driving the electrothermal transducers H1103.

In this embodiment, signal lines to supply signals to select the driving elements H1116 to drive the electrothermal transducers H1103 are used as signal lines to supply signals to select the driving elements H1118 to drive the fuse ROMs H1117. In this embodiment, the block enable signal lines to select the electrothermal transducers are shared to select fuses to be melted or accessed to read out information.

In order for the signal lines elongated along the long side end of the substrate to be shared, the driving elements H1118 to drive the fuses have the same structure as the driving elements H1116 to drive the electrothermal transducers and exist on the same arrays. The fuse ROMs H1117 arranged on both sides of the extension of the ink supply port to be driven by the driving elements H1118 are arranged in the intermediate region sandwiched between the extensions of the array directions of the driving elements H1118. This enables to obtain the ID terminal commonly connected to the fuses included in the fuse ROMs from a short side of the head substrate. Hence, the driving elements, fuse ROMs, and ID wirings can be arranged efficiently.

In this embodiment, a portion from a signal line (no electrode pad is illustrated) to receive a signal from the outside of the head substrate to a signal line connected to the driving element H1118 through a shift register (S/R) H1201, latch circuit (LT) H1202, and decoder (DECODER) H1203 shares the circuit to select the driving element H1116. A selection circuit (AND circuit) H1112 for finally selecting the driving element H1118 on the basis of the output from the shift register has the same structure as the selection circuit (AND circuit) for the driving element H1116.

Each VH pad 1104*c* to supply VH power connects to the electrothermal transducers H1103 through a VH wiring H1114. Each GNDH pad H1104*d* to supply GNDH power commonly connects to the driving elements H1116 connected to the electrothermal transducers H1103 and the driving elements H1118 connected to the fuse ROMs H1117 through a GNDH wiring H1113. That is, the driving elements H1116 and H1118 share the GNDH wirings H1113.

As described above, in this embodiment, a circuit having the same arrangement as the circuit for selecting the driving element H1116 so as to select electrothermal transducer H1103, including a signal line to transfer a selection signal of the driving element H1116, the decoder (DECODER) H1203 for generating a time-division selection signal (BLE), the latch circuit (LT) H1202 and shift register (SIR) H1201 including the other signals, and a signal input pad (not shown) from the outside of the head substrate, is used for selecting a fuse ROM. This makes it possible to select the driving element H1118 to drive the fuse ROM H1117 without adding any new signal line, wiring region, and circuit.

An ID pad H1104*a* functions as a fuse melting power supply terminal to apply a voltage in melting the fuse ROM H1117 and as a signal output terminal in reading out information from the fuse ROM. More specifically, to melt the fuse ROM H1117, a voltage (e.g., the driving voltage (24 V) of the electrothermal transducer) is applied to the ID pad H1104*a* to drive the driving element H1118 selected by the selection circuit and instantaneously melt the corresponding fuse ROM H1117. At this time, an ID power supply pad H1104*b* serving as a fuse read power supply terminal is kept open. On the other hand, to read out information, a voltage (e.g., the power supply voltage (3.3 V) of the logic circuit) is applied to the ID power supply pad H1104*b*. If the fuse ROM H1117 is open, a high-level (H) signal is output to the ID pad H1104*a*. If the fuse ROM H1117 is not open, a low-level (L) signal is output to the ID pad H1104*a* because of a read resistance H1111 significantly larger than the resistance value of the fuse ROM H1117.

As is apparent from the above description, a fuse ROM is designed to be melt upon receiving a voltage (e.g., 24 V) to drive the electrothermal transducers. Hence, the conventional power supply arrangement is usable to melt the fuse ROM without adding any new power supply on the printing apparatus side. Similarly, use of the power supply voltage of the logic circuit allows to design the fuse ROM H1117 that does not give any damage on elements on the head substrate upon reading, without adding any new power supply on the printing apparatus side. The printing apparatus side can receive a signal from the fuse ROM H1117 by using an existing circuit.

Figure 12:
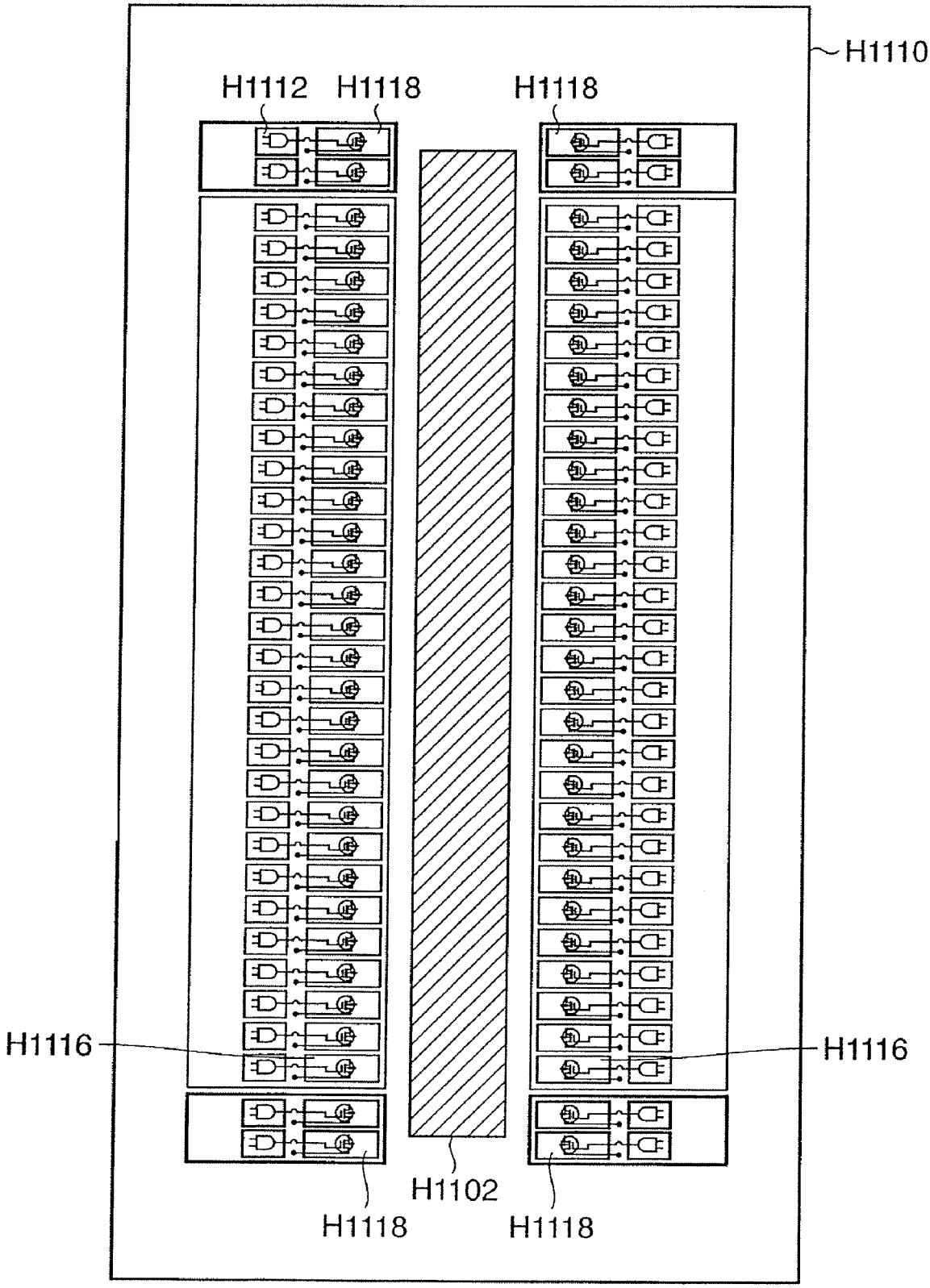
FIG. 12 is a view showing the overall layout of driving elements to drive fuse ROMs and AND circuits to select the driving elements.

FIG. 12 is a view showing the overall layout of the driving elements to drive the fuse ROMs and the AND circuits to select the driving elements.

As shown in FIG. 12, the driving elements H1118 are arranged adjacent on both sides of the driving elements H1116 which are arrayed in the substrate longitudinal direction (longitudinal direction) on both sides of the ink supply port H1102 and its extension. The AND circuit H1112 is arranged on the rear side of each driving element H1118.

On the basis of the layout arrangement of the driving elements and selection circuits of the fuse ROMs shown in FIG. 12, the logic circuits such as the shift registers (S/R) H1201, latch circuits (LT) H1202, and decoders (DECODER) H1203 can have various layouts.

Figure 13:
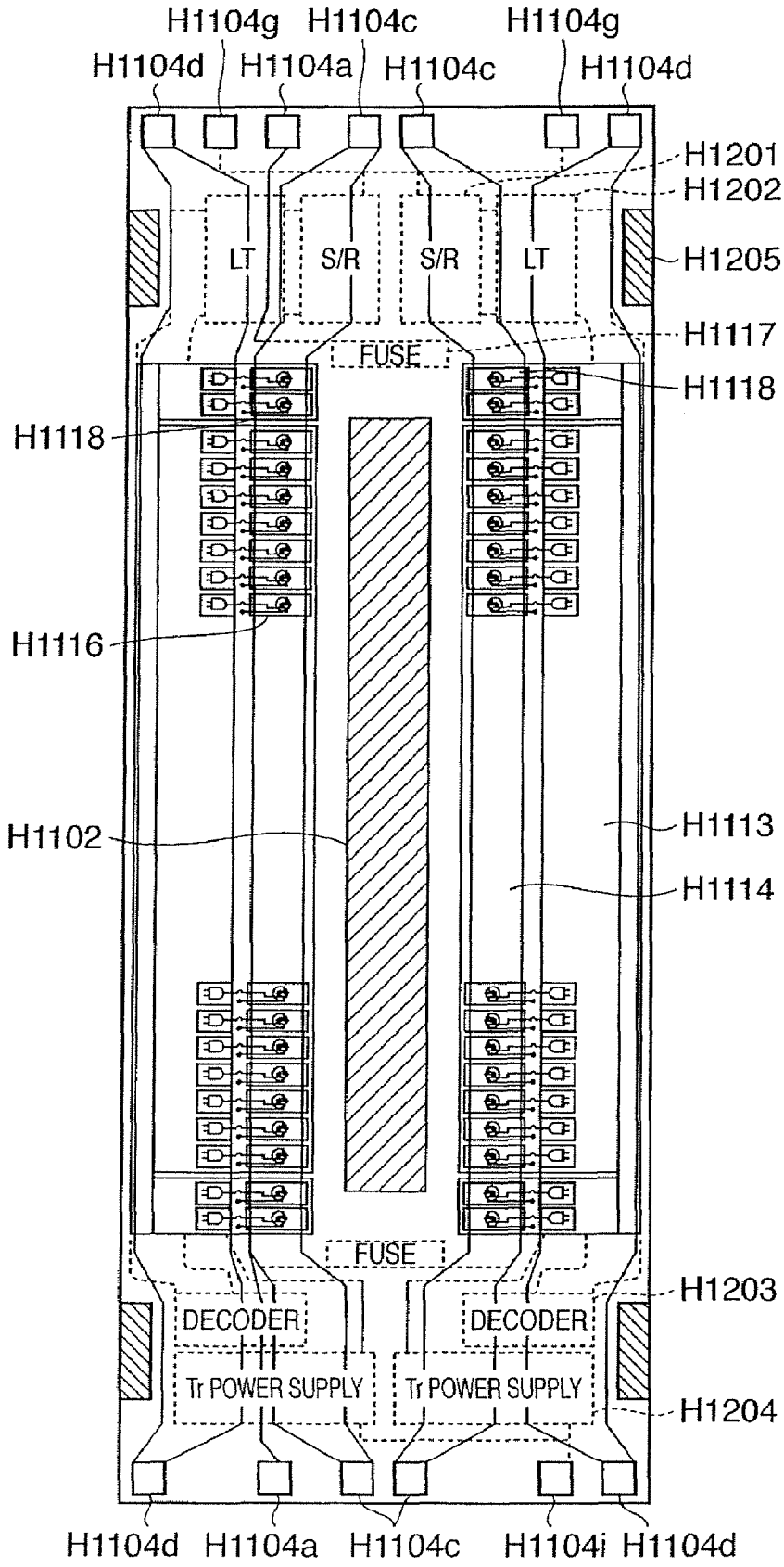
FIG. 13 is a view showing the overall layout of the head substrate.

FIG. 13 is a view showing the overall layout of the head substrate. The same reference numerals as described above denote the same constituent elements in FIG. 13.

As shown in FIG. 13, the shift registers (S/R) H1201 and latch circuits (LT) H1202 may be arranged on one side of the printhead H1100 in the longitudinal direction while the decoders (DECODER) H1203 may be arranged on the other side. Power supply circuits (Tr power supplies) H1204 to supply power to the driving elements H1116 and H1118 are arranged on the same side as the decoders (DECODER) H1203.

Referring to FIG. 13, the GNDH wirings H1113 and VH wirings H1114 are illustrated as wiring regions, unlike FIG. 11. The fuse ROMs H1117 are collectively represented by "FUSE". The electrode pad layout is different from FIG. 11 because it reflects the embodiment. Reference numeral H1104*g* denotes a data signal (DATA)/block selection signals (B0 to B3) input pad. An input pad H11041 supplies power to the power supply circuits (Tr power supplies) H1204. Alignment marks H1205 are used upon assembling the printhead. The fuse ROMs and electrothermal transducers share the GNDH wirings H1113.

According to the above-described embodiment, the logic circuit arrangement is partially shared to write/read information in/from a fuse ROM. The fuse ROMs are arranged by using the space between the logic circuits. Hence, a head substrate having a fuse ROM serving as a storage element can be provided without increasing the head substrate size.

The driving elements H1118 are arranged adjacent to the driving elements H1116 which are arrayed on both sides of the ink supply port H1102 and its extension. This allows the elements for selectively driving the fuse ROMs to be well-balanced distributed in the head substrate regardless of the number of bits of fuse ROMs and the number of ink supply ports, resulting in suppressing any increase in the head substrate size.

The fuse ROMs are arranged in the intermediate region sandwiched between the extensions of the arrays of the driving elements. Hence, the fuses can be arranged while avoiding the VH wirings and GND wirings.

When the fuse ROMs are arranged in the intermediate region between the logic circuits such as shift registers and the ink supply port (example in FIG. 13), a free space where there are no wirings and circuits on and under the fuse ROMs can effectively be used. Hence, the circuit layout efficiency on the head substrate becomes high.

The layout relationship between the ink supply port, the circuits including fuses, and the wirings on the head substrate has been described above. The following points are preferably taken into consideration even for the relationship with the members included in the liquid channel wall of the printhead.

A resin layer to form the ink channel is formed on the head substrate. If the fuses are arranged near the ink supply port, as described above, ink that has permeated between the substrate surface and the resin layer may corrode the fuses. To prevent this, the resin layer that forms the channel is partially removed, as indicated by H1117*b* in FIG. 5. The fuses are arranged at positions (on the side close to an end of the substrate) spaced apart further away from the ink supply port than the removed part. This allows to maintain the layout arrangement and increase the reliability of the fuses.

A printhead H1101 used in a printhead cartridge H1001 for color printing basically has the same structure as described above. However, the logic circuits such as the shift registers (S/R) H1201, latch circuits (LT) H1202, and decoders (DECODER) H1203 and the input pads around the head substrate can have various layouts.

Some layouts applicable to the head substrate for color printing will be described below.

FIRST EXAMPLE

Figure 14:
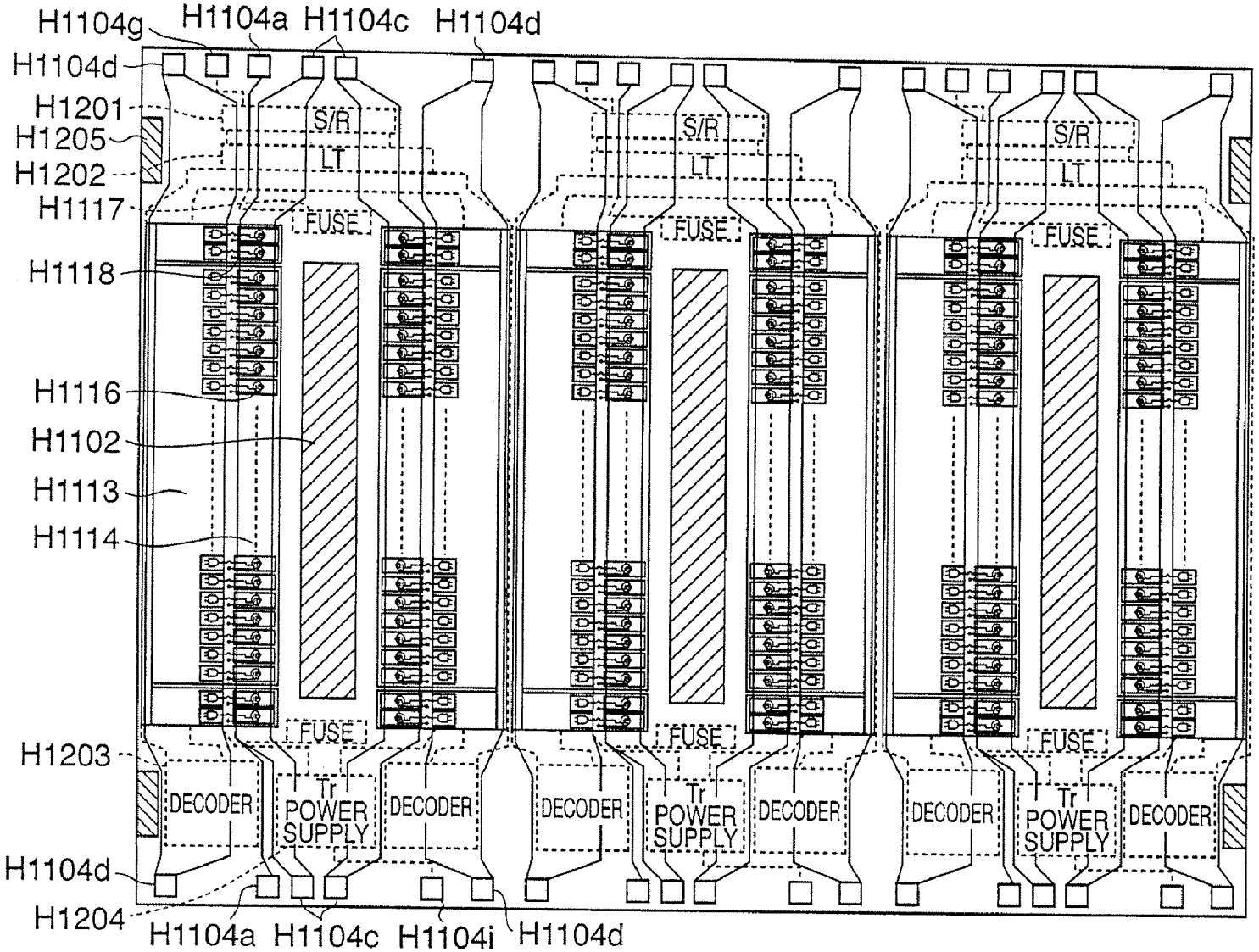
FIG. 14 is a view showing one example of the layout of the head substrate H1110.

FIG. 14 is a view showing an example of the layout of the head substrate H1110.

As shown in FIG. 14, the head substrate H1110 has three ink supply ports H1102 corresponding to three color inks. Identical circuit arrangements are arranged around the ink supply ports.

In this example, the shift registers (S/R) H1201 and latch circuits (LT) H1202 to supply a printing signal and control signal to the driving elements and selection circuits arranged on both sides of each ink supply port H1102 are arranged in the region between the fuse ROMs (FUSE) and the input pad group on the upper side of the head substrate. On the other hand, the decoders (DECODER) H1203 and power supply circuits (Tr power supplies) H1204 to supply a time-division selection signal and driving power to the driving elements and selection circuits arranged on both sides of each ink supply port H1102 are arranged in the region between the fuse ROMs (FUSE) and the input pad group on the lower side of the head substrate.

SECOND EXAMPLE

Figure 15:
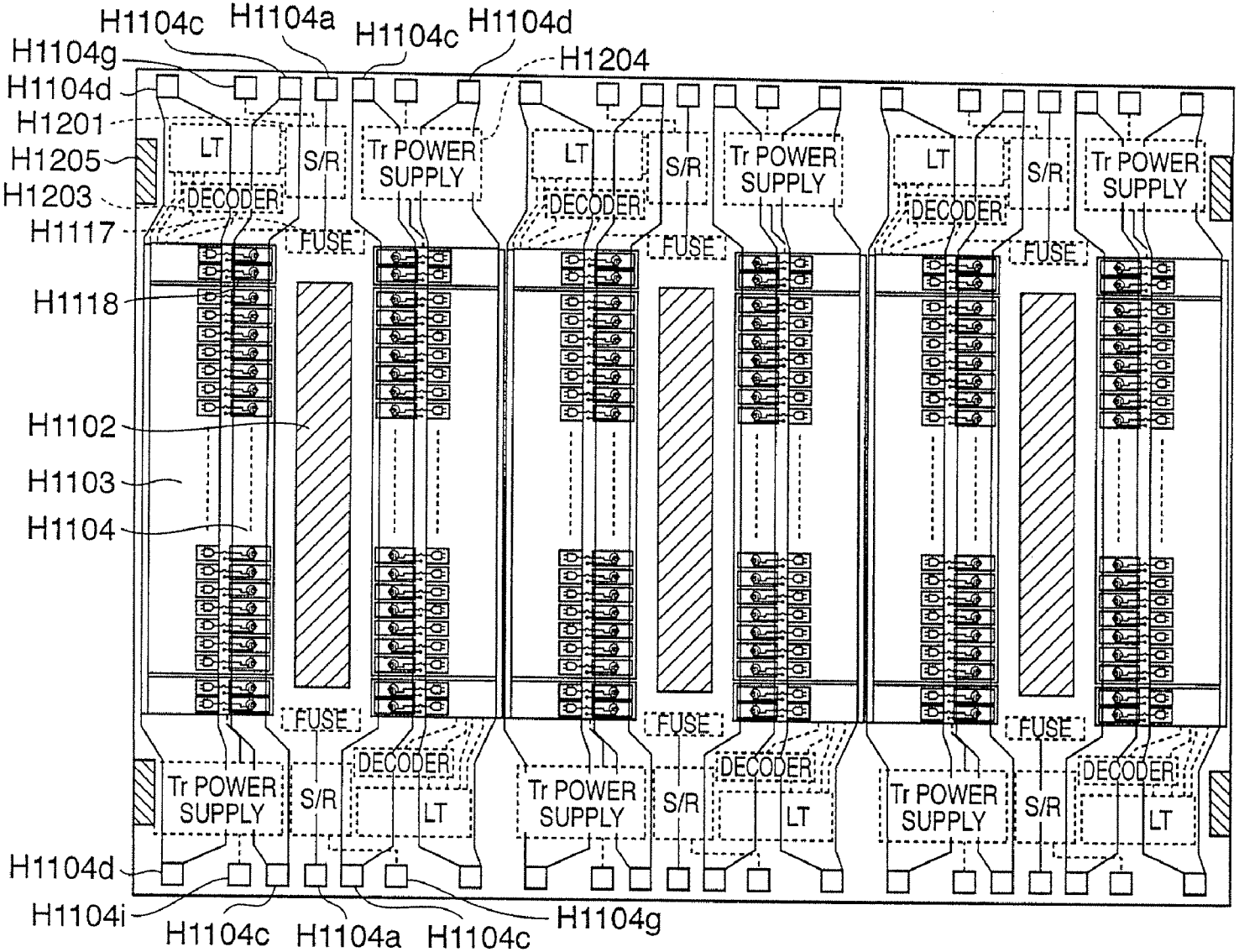
FIG. 15 is a view showing another example of the layout of the head substrate H1110.

FIG. 15 is a view showing another example of the layout of the head substrate H1110.

As shown in FIG. 15, the head substrate H1110 has three ink supply ports H1102 corresponding to three color inks. Identical circuit arrangements are arranged around the ink supply ports.

In this example, the shift register (S/R) H1201, latch circuit (LT) H1202, and decoder (DECODER) H1203 to supply a printing signal, control signal, time-division selection signal, and driving power to the driving elements and selection circuits arranged on the left side of each ink supply port H1102 are arranged in the region between the fuse ROMs (FUSE) and the input pad group on the upper side of the head substrate. On the other hand, the shift register (S/R) H1201, latch circuit (LT) H1202, decoder (DECODER) H1203, and power supply circuit (Tr power supply) H1204 to supply a printing signal, control signal, time-division selection signal, and driving power to the driving elements and selection circuits arranged on the right side of each ink supply port H1102 are arranged in the region between the fuse ROMs (FUSE) and the input pad group on the lower side of the head substrate.

The power supply circuit (Tr power supply) to drive elements on the left side of each ink supply port H1102 is arranged at the lower left on the drawing. The power supply circuit (Tr power supply) to drive elements on the right side is arranged at the upper right on the drawing.

THIRD EXAMPLE

Figure 16:
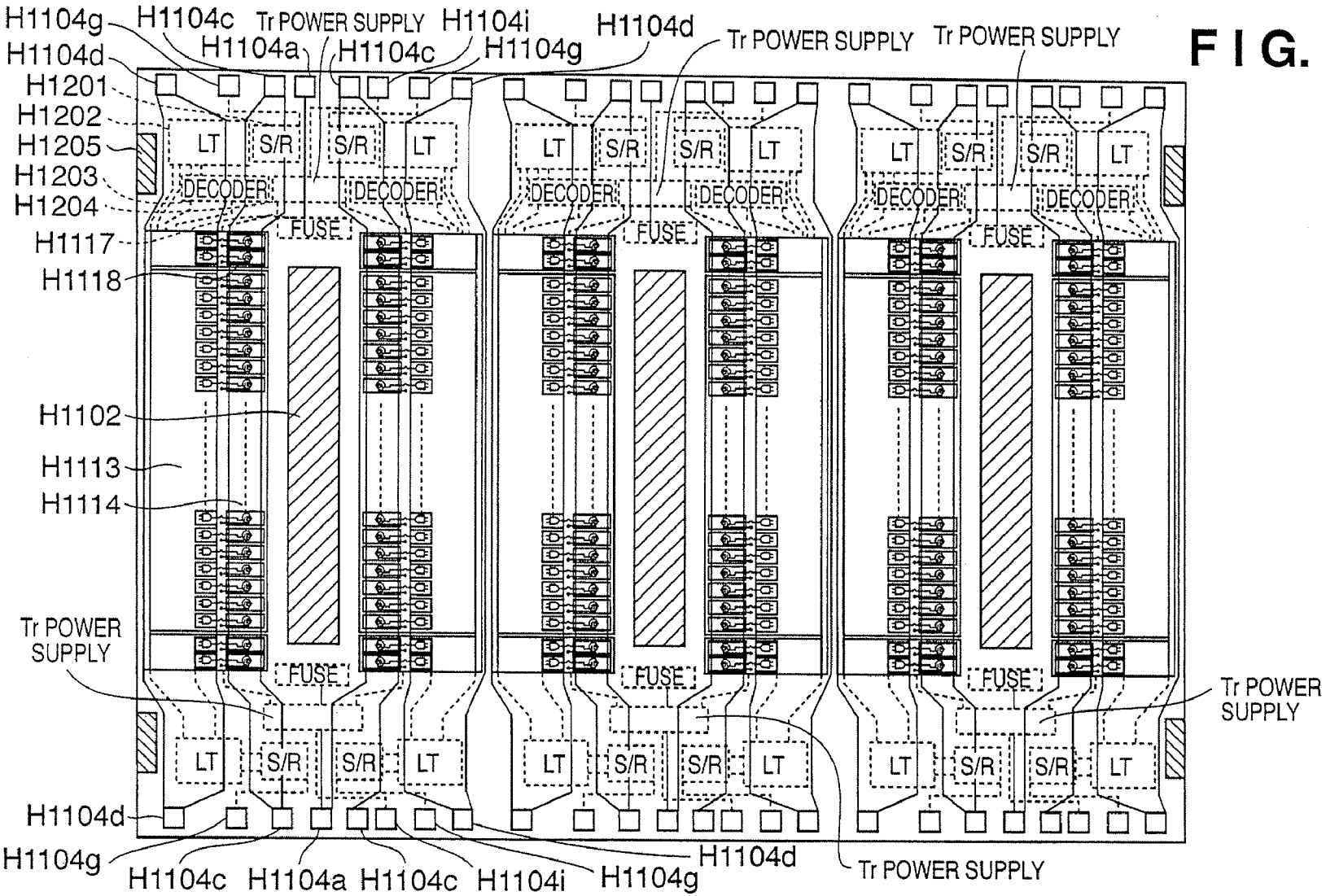
FIG. 16 is a view showing still another example of the layout of the head substrate H1110.

FIG. 16 is a view showing still another example of the layout of the head substrate H1110.

As shown in FIG. 16, the head substrate H1110 has three ink supply ports H1102 corresponding to three color inks. Identical circuit arrangements are arranged around the ink supply ports.

In this example, the shift register (S/R) H1201, latch circuit (LT) H1202, and power supply circuit (Tr power supply) H1204 to supply a printing signal, control signal, and driving power to the upper half of the driving elements and selection circuits arranged on both sides of each ink supply port H1102 are arranged in the region between the fuse ROMs (FUSE) and the input pad group on the upper side of the head substrate. On the other hand, the shift register (S/R) H1201, latch circuit (LT) H1202, and power supply circuit (Tr power supply) H1204 to supply a printing signal, control signal, and driving power to the lower half of the driving elements and selection circuits arranged on both sides of each ink supply port H1102 are arranged in the region between the fuse ROMs (FUSE) and the input pad group on the lower side of the head substrate. The half portion need not be just ½ the substrate in the longitudinal direction.

The decoders (DECODER) H1203 to supply a time-division selection signal to the driving elements and selection circuits arranged on both sides of each ink supply port H1102 are arranged in the region between the fuse ROMs (FUSE) and the input pad group on the upper side of the head substrate.

As is apparent from FIG. 16, the four shift registers (S/R) H1201 and four latch circuits (LT) H1202 arranged around each ink supply port H1102 are responsible for supplying a printing signal and control signal to the driving elements and selection circuits arranged at the upper left portion, lower left portion, upper right portion, and lower right portion of the ink supply port H1102, respectively.

Figure 17:
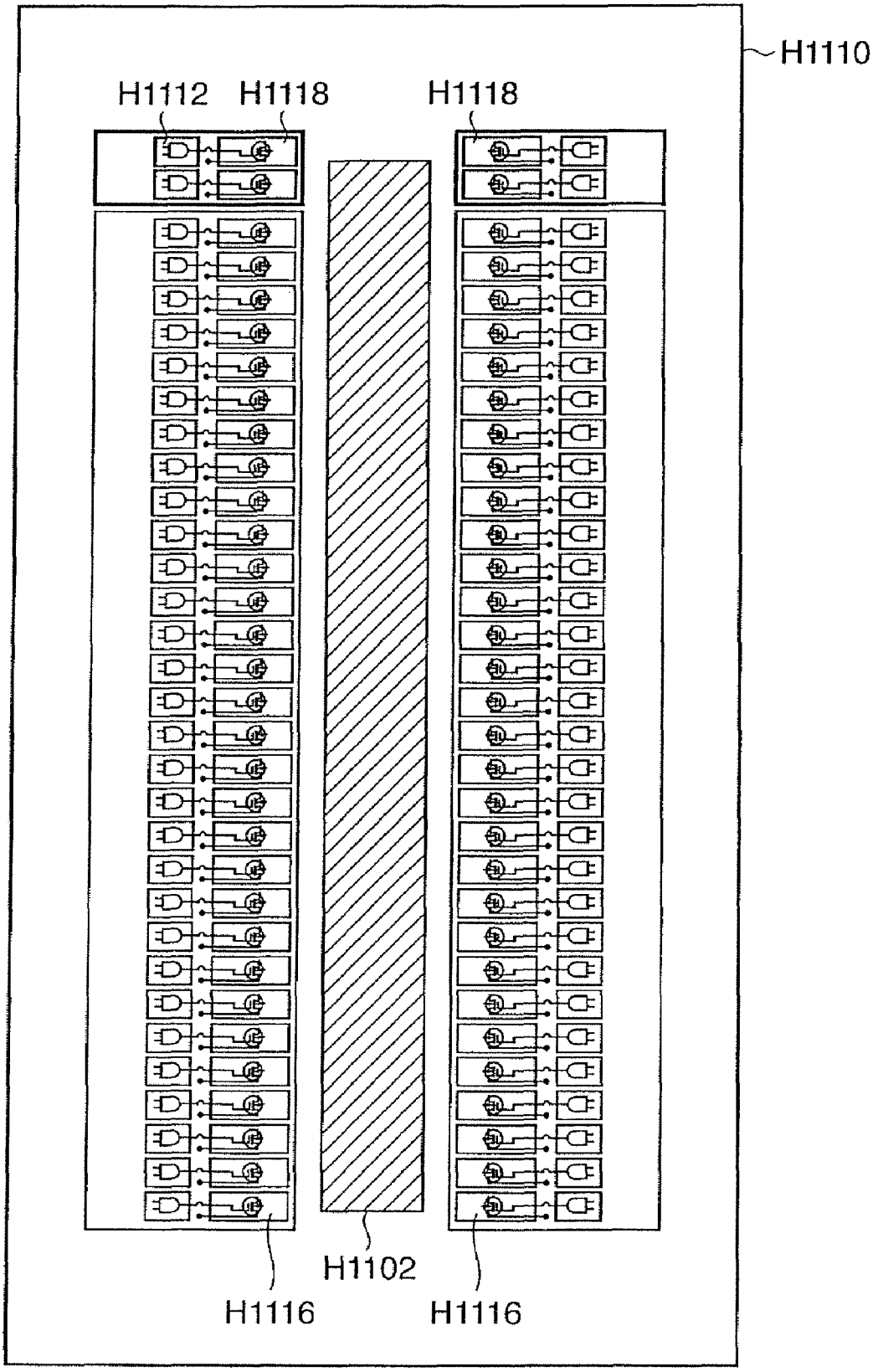
FIG. 17 is a view showing another layout of the driving elements to drive fuse ROMs and the selection circuits.

In the above-described examples, the driving elements H1118 are arranged adjacent on both sides of each of the arrays of the driving elements H1116 on both sides of the ink supply port H1102. The AND circuit H1112 is arranged on the rear side of each driving element H1118. However, the present invention is not limited to this. For example, if the information storage amount required of the fuse ROM is small, it is unnecessary to arrange the fuse ROMs shown in FIGS. 13 to 16 on both sides of the head substrate. Instead, they may be arranged on one side of the head substrate. In this case, for example, the driving elements H1118 may be arranged on only one side of each of the arrays of the driving elements H1116 on both sides of the ink supply port H1102, as shown in FIG. 17. Even this layout allows the elements for selectively driving the fuse ROMs to be well-balanced distributed. This results in efficiently utilizing the space on the head substrate.

Second Embodiment

All the examples described in the first embodiment employ an arrangement with the fuse ROMs laid out on the extension of the rectangular ink supply port in the longitudinal direction. An arrangement with fuse ROMs laid out between an ink supply port and driving elements, like electrothermal transducers H1103, will be described here. Even in this embodiment, the fuses are arranged in the intermediate region sandwiched between the extensions of the driving elements arranged on both sides of the ink supply port.

Figure 18:
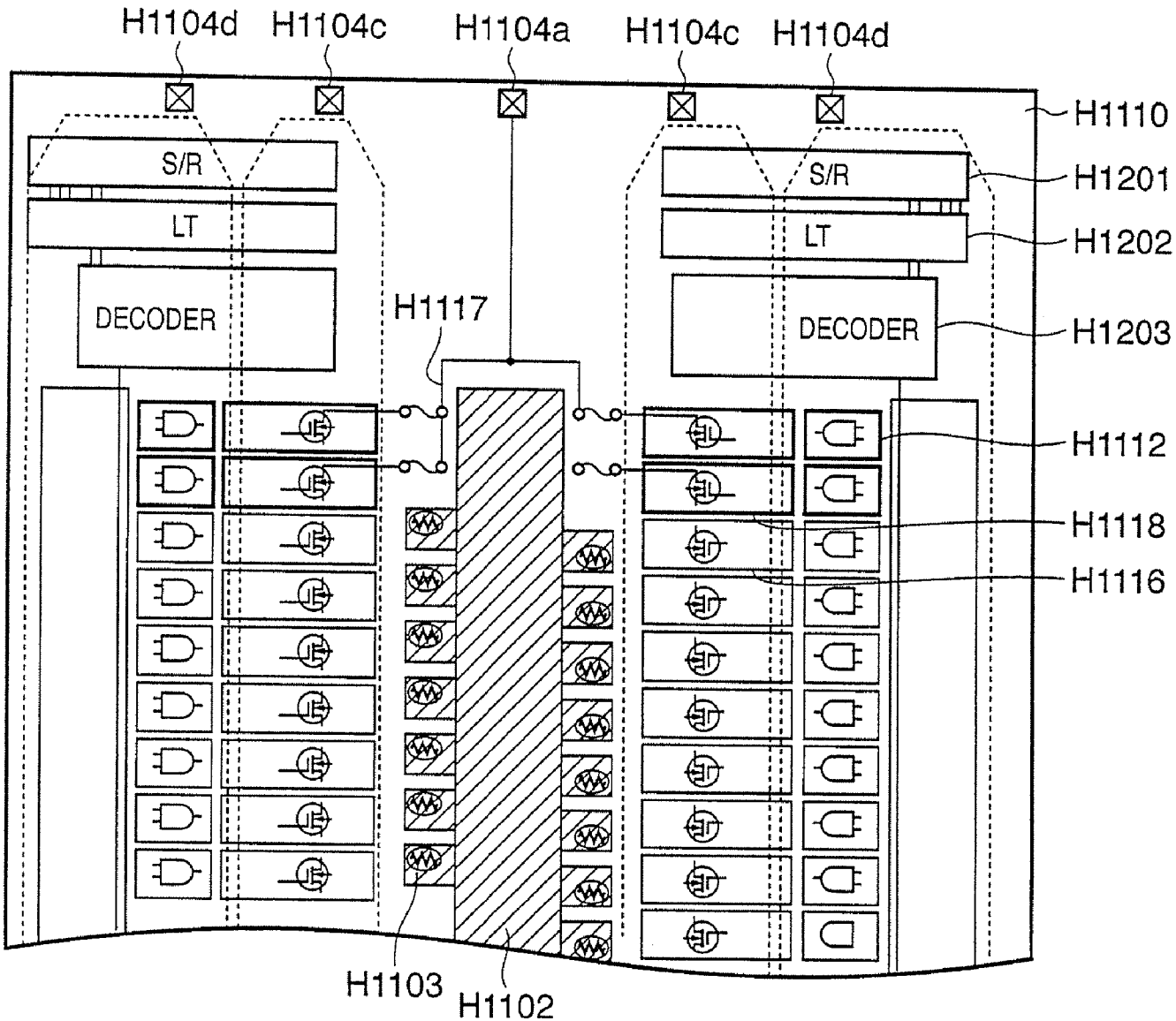
FIG. 18 is a view showing the layout of a head substrate H1110 according to the second embodiment.

FIG. 18 is a view showing the layout of a head substrate according to the second embodiment. A printhead H1100 has semiconductor elements and wirings formed on a head substrate H1110 by a semiconductor process.

In the second embodiment, the head substrate H1110 has fuse ROMs to store information unique to the head and necessary peripheral circuits, as in the first embodiment. FIG. 18 shows part of the head substrate. The same reference numerals as described above denote the same constituent elements in FIG. 18, and a description thereof will be omitted.

As shown in FIG. 18, fuse ROMs H1117 are arranged between an ink supply port H1102 and driving elements H1118 for driving the fuse ROMs, like the electrothermal transducers H1103. In this case, considering the safety in melting a fuse ROM, the interval between the fuse ROM H1117 and the electrothermal transducer H1103 is equal to or greater than that between the electrothermal transducers H1103.

According to the above-described embodiment, the fuse ROMs are arranged in a space between the ink supply port and the driving elements, compared to the arrangement described in the first embodiment with reference to FIG. 11. Hence, it is possible to more efficiently use the space on the head substrate.

Third Embodiment

The examples described in the first and second embodiments have the logic circuits such as a shift register, latch circuit, and decoder mounted on the head substrate. An arrangement with logic circuits outside a head substrate will be described here.

Although shift registers, latch circuits, and decoders are present outside the head substrate, they still share signal lines for selecting driving elements to drive heating elements and driving elements to drive the fuses.

Figure 19:
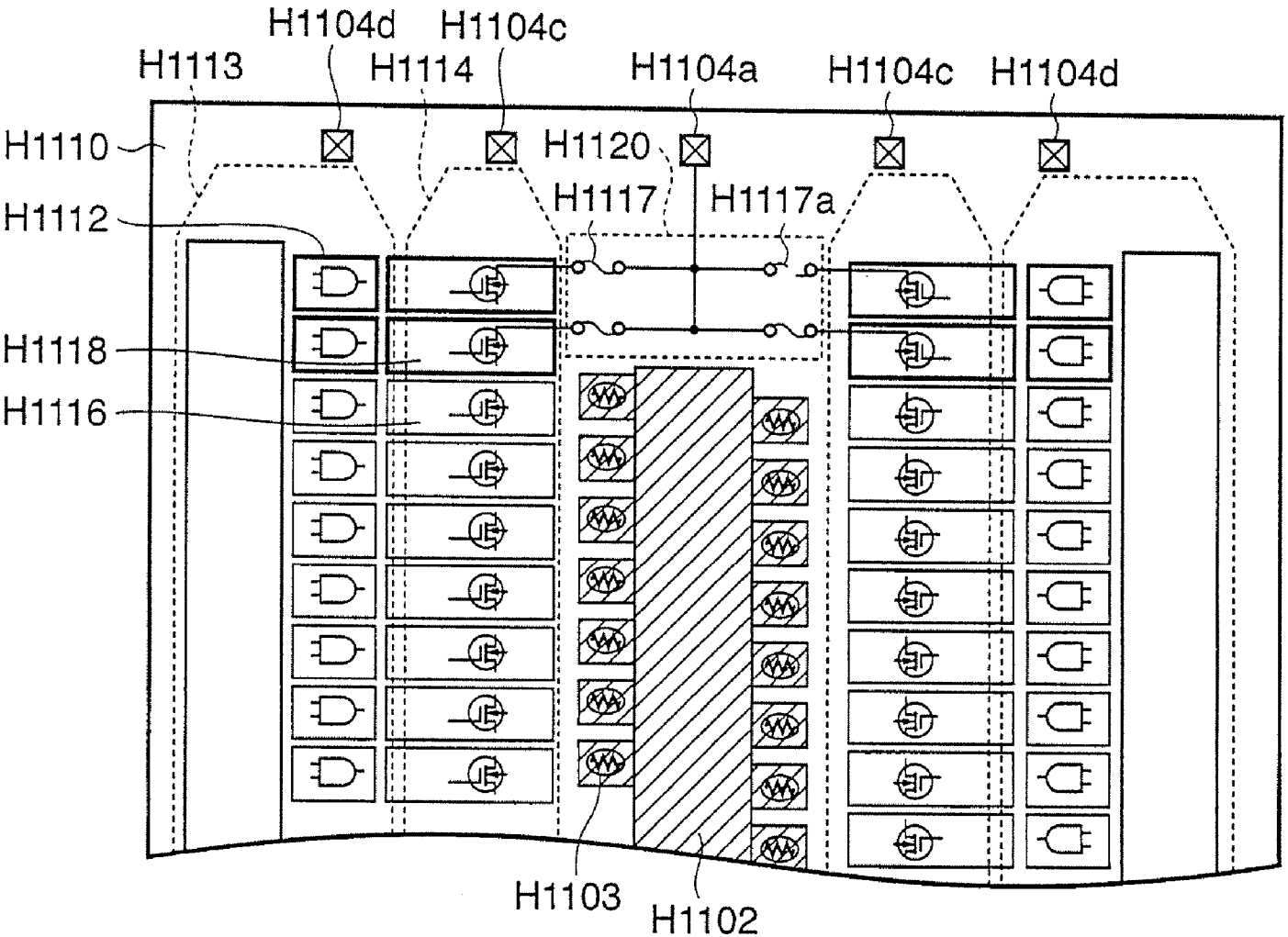
FIG. 19 is a view showing the layout of a head substrate H1110 according to the third embodiment.
Figure 20:
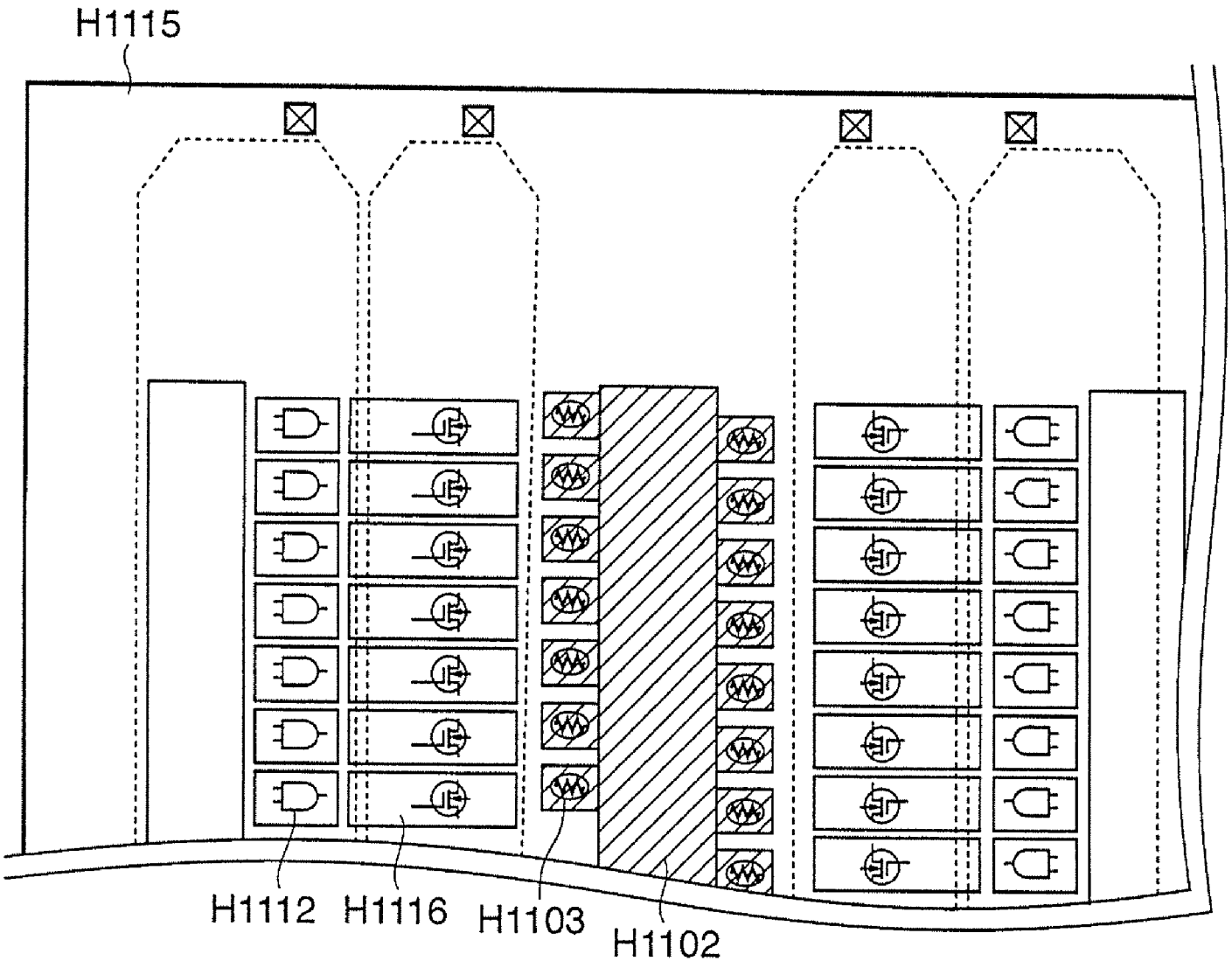
FIG. 20 is a view showing the circuit layout in a head substrate.

FIG. 19 is a view showing the layout of a head substrate according to the third embodiment. A printhead H1100 has semiconductor elements and wirings formed on a head substrate H1110 by a semiconductor process.

In the third embodiment, the head substrate H1110 has fuse ROMs to store information unique to the head, as in the first and second embodiments. FIG. 19 shows part of the head substrate. The same reference numerals as described above denote the same constituent elements in FIG. 19, and a description thereof will be omitted.

As shown in FIG. 19, driving elements H1118 are arranged adjacent at one end of driving elements H1116 which are arrayed on both sides of an ink supply port H1102. An AND circuit H1112 is arranged on the rear side of each driving element H1118. This allows the arrangement up to the selection circuit (AND circuit) H1112 for inputting a selection signal to the driving element H1118 to be laid out in the same manner as the driving elements H1116. This results in avoiding influence on the layout of the opening of the ink supply port H1102 and signal lines.

The driving elements H1116 for driving electrothermal transducers H1103 and the driving elements H1118 for driving the fuse ROMs H1117 share GNDH wirings H1113, as described in the first embodiment. This arrangement results in eliminating the necessity of collective arrangement of the circuits for selectively driving the fuse ROMs H1117, and it contributes to effective utilization of the space on the head substrate.

In the layout according to this embodiment, the fuse ROMs are arranged in a region H1120 surrounded by a broken line. As shown in FIG. 19, the region H1120 is defined as not only a region that exists on the extension of the rectangular ink supply port H1102 in the longitudinal direction but also a region that is sandwiched between the opposing driving elements H1118 arranged adjacent at the ends of the arrays of the driving elements H1116 on both sides of the ink supply port H1102.

Since there are no power supply wirings of the electrothermal transducers H1103 in the region H1120, the fuse ROMs H1117 can advantageously be arranged without influencing the wirings.

This layout will be compared with a conventional art.

As described in the conventional art, the fuse ROMs H1117 are melted. Hence, it is impossible to place any elements and wirings on or under the layout region of the fuse ROMs on the head substrate from the viewpoint of safety and reliability. Especially the fuse ROMs need be arranged while avoiding the power supply wirings to the electrothermal transducers H1103, which cover most part of the surface of the head substrate so as to accurately control the thermal energy to be generated and suppress excess heating. Additionally, the fuse ROMs need to be arranged while avoiding the ink orifices and the ink supply port passing through the head substrate from the back surface to the front surface to supply ink to the ink orifices.

To the contrary, the layout according to the third embodiment enables to lay out the fuse ROMs by efficiently using a region, near the ink supply port, where there are no power supply wirings of the electrothermal transducers H1103, and which is sandwiched between the opposing driving elements. Hence, the space on the head substrate can effectively be used without wasting the space.

A printhead H1101 basically has the same structure as described above.

In the above-described embodiments, the droplet discharged from the printhead is an ink droplet, and the liquid stored in the ink tank is ink. However, the content is not limited to ink. The ink tank may store, e.g., process liquid that is discharged to the printing medium to increase the adhesion and water repellency of a printed image and/or increase the quality of the image.

The present invention is also effective for the above-described serial type printhead, a printhead fixed to the apparatus main body, or an exchangeable cartridge type printhead capable of ensuring electrical connection to the apparatus main body when attached to it and receiving ink from the apparatus main body.

The inkjet printing apparatus of the present invention can take any form such as an image output device for an information processing device such as a computer, a copying machine combined with a reader, or a facsimile apparatus having a transmitting/receiving function.

The present invention is not limited to the above embodiments, and various changes and modifications can be made within the spirit and scope of the present invention. Therefore, to apprise the public of the scope of the present invention, the following claims are made.

CLAIM OF PRIORITY

This application claims the benefit of Japanese Patent Application No. 2004-164555, filed Jun. 2, 2004 and Japanese Patent Application No. 2005-149620, filed May 23, 2005 which are hereby incorporated by reference herein in their entirety.

The invention claimed is:

1. A rectangular head substrate comprising:

an ink supply port which has a long hole shape elongated in a first direction;

a plurality of printing elements arrayed along the first direction on both sides of said ink supply port;

a plurality of first driving elements, arrayed along the first direction at positions spaced apart further away from said ink supply port than said plurality of printing elements, for driving said plurality of printing elements;

a plurality of fuse ROMs for storing information, arranged at both ends of extensions from said ink supply port in the first direction;

a plurality of second driving elements for driving said plurality of fuse ROMs;

shared signal lines used for driving said plurality of first driving elements and said plurality of second driving elements;

a power supply circuit for supplying power to said plurality of first driving elements and said plurality of second driving elements;

a serial-parallel conversion circuit, connected to at least part of said shared signal lines, arranged at one end of the extensions in the first direction;

a decoder, connected to at least part of said shared signal lines, arranged at the other end of the extensions in the first direction; and input pads, connected to either said serial-parallel conversion circuit or said power supply circuit, for receiving signals inputted from outside of said head substrate, wherein said first driving elements and said second driving elements are arrayed along the first direction on both sides of the extensions from said ink supply port, forming continuous arrays.

said plurality of the ROMS are arranged at an intermediate area between said ink supply port and either said serial-parallel conversion circuit or said decoder, said power supply circuit is arranged at an area adjacent to said decoder, and said input pads are arranged at both of shorter sides of said rectangular head substrate.

2. The head substrate according to claim 1, wherein said serial-parallel conversion circuit is comprised of a shift-register and a latch circuit.

3. A rectangular head substrate comprising:

a plurality of ink supply ports, each of which has a long hole shape elongated in a first direction;

a plurality of printing elements arrayed along the first direction on both sides of each of said plurality of ink supply ports;

a plurality of first driving elements, arrayed along the first direction at positions spaced apart further away from a corresponding one of said plurality of ink supply ports than corresponding ones of said plurality of printing elements, for driving said plurality of printing elements;

a plurality of fuse ROMs for storing information, arranged at both ends of extensions from each one of said plurality of ink supply ports in the first direction;

a plurality of second driving elements for driving said plurality of fuse ROMs;

shared signal lines used for driving said plurality of first driving elements and said plurality of second driving elements, associated with each of said plurality of ink supply ports;

power supply circuits for supplying power to said plurality of first driving elements and said plurality of second driving elements, associated with each of said plurality of ink supply ports;

serial-parallel conversion circuits, connected to at least part of said shared signal lines, arranged at one end of the extensions in the first direction, associated with each of said plurality of ink supply ports;

decoders, connected to at least part of said shared signal lines, arranged at the other end of the extensions in the first direction, associated with each of said plurality of ink supply ports; and input pads, connected to either said serial-parallel conversion circuits or said power supply circuits, for receiving signals inputted from outside of said head substrate, wherein said first driving elements and said second driving elements are arrayed along the first direction on both sides of the extensions from each of said plurality of ink supply ports, forming continuous arrays, said plurality of fuse ROMs are arranged at intermediate areas between each one of said plurality of ink supply ports and either said serial-parallel conversion circuits or said power supply circuits, each of said serial-parallel conversion circuits is common to corresponding ones of the arrayed first and second driving elements at both sides of a corresponding one of said plurality of ink supply ports, said decoders are respectively arranged along corresponding ones of the continuous arrays, each of said power supply circuits is arranged between said decoders, and is common to corresponding ones of the arrayed first and second driving elements arranged at both sides of a corresponding one of said plurality of ink supply ports, and said input pads are arranged at sides of said rectangular head substrate in a direction perpendicular to the first direction.

4. The head substrate according to claim 3, wherein each of said serial-parallel conversion circuits is comprised of a shift-register and a latch circuit.

5. A rectangular head substrate comprising:

a plurality of ink supply ports, each of which has a long hole shape elongated in a first direction;

a plurality of printing elements arrayed along the first direction on both sides of each of said plurality of ink supply ports;

a plurality of first driving elements, arrayed along the first direction at positions spaced apart further away from a corresponding one of said plurality of ink supply ports than corresponding ones of said plurality of printing elements, for driving said plurality of printing elements;

a plurality of fuse ROMs for storing information, arranged at both ends of extensions from each one of said plurality of ink supply ports in the first direction;

a plurality of second driving elements for driving said plurality of fuse ROMs;

first shared signal lines used for driving a first part of said plurality of first and second driving elements, and which are arranged along the first direction at one side of each of said plurality of ink supply ports;

second shared signal lines used for driving a second part of said plurality of first and second driving elements, and which are arranged along the first direction at the other side of each of said plurality of ink supply ports;

first power supply circuits for supplying power to the first part of said plurality of first and second driving elements driven via said first shared signal lines, one of said first power supply circuits associated with each of said plurality of ink supply ports;

second power supply circuits for supplying power to the second part of said plurality of first and second driving elements driven via said second shared signal lines, one of said second power supply circuits associated with each of said plurality of ink supply ports;

first serial-parallel conversion circuits, connected to at least part of said first shared signal lines, arranged at the same side as that where the first part of said plurality of first and second driving elements are arranged, one of said first serial-parallel conversion circuits associated with each of said plurality of ink supply ports;

second serial-parallel conversion circuits, connected to at least part of said second shared signal lines, arranged at the same side as that where the second part of said plurality of first and second driving elements are arranged, one of said second serial-parallel conversion circuits associated with each of said plurality of ink supply ports;

first decoders arranged at areas between said first serial-parallel conversion circuits and the first part of said plurality of first and second driving elements, one of said first decoders associated with each of said plurality of ink supply ports;

second decoders arranged at areas between said second serial-parallel conversion circuits and the second part of said plurality of first and second driving elements, one of said second decoders associated with each of said plurality of ink supply ports; and input pads, connected to either said first and second serial-parallel conversion circuits or said first and second power supply circuits, for receiving signals inputted from outside of said head substrate, said input pads associated with each of said plurality of ink supply ports, wherein the first part of said plurality of first and second driving elements forms a first continuous away along the first direction, and the first continuous away is arranged in an area between said first power supply circuit, said first decoder and said first serial-parallel conversion circuit corresponding to each of said plurality of ink supply ports, the second part of said plurality of first and second driving elements forms a second continuous away along the first direction, and the second continuous away is arranged in an area between said second power supply circuit, said second decoder and said second serial-parallel conversion circuit corresponding to each of said plurality of ink supply ports, a first part of said plurality of fuse ROMs, which corresponds to the first part of said plurality of first and second driving elements, is arranged in an area surrounded by each one of said plurality of ink supply ports, the first part of corresponding ones of said plurality of first and second driving elements, a corresponding one of said first serial-parallel conversion circuit, and a corresponding one of said first power supply circuit, a second part of said plurality of fuse ROMs, which corresponds to the second part of said plurality of first and second driving elements, is arranged in an area surrounded by each one of said plurality of ink supply ports, the second part of corresponding ones of said plurality of first and second driving elements, a corresponding one of said second serial-parallel conversion circuit, and a corresponding one of said second power supply circuit, said input pads are arranged at sides of said rectangular head substrate in a direction perpendicular to the first direction, and said first and second power supply circuits, said first and second serial-parallel conversion circuits, said first and second decoders, and said first and second parts of said plurality of fuse ROMs are approximately point-symmetrically arranged with respect to each of said plurality of ink supply ports.

6. The head substrate according to claim 5, wherein each of said first and second serial-parallel conversion circuits are comprised of a shift-register and a latch circuit.

* * * * *